US007825878B2

(12) United States Patent
Kawabe

(10) Patent No.: US 7,825,878 B2
(45) Date of Patent: Nov. 2, 2010

(54) ACTIVE MATRIX DISPLAY DEVICE

(75) Inventor: Kazuyoshi Kawabe, Yokohama (JP)

(73) Assignee: Global OLED Technology LLC, Wilmington, DE (US)

( * ) Notice: Subject to any disclaimer, the term of this patent is extended or adjusted under 35 U.S.C. 154(b) by 1015 days.

(21) Appl. No.: 11/568,997

(22) PCT Filed: May 10, 2005

(86) PCT No.: PCT/US2005/016575

§ 371 (c)(1),
(2), (4) Date: Nov. 13, 2006

(87) PCT Pub. No.: WO2005/116971

PCT Pub. Date: Dec. 8, 2005

(65) Prior Publication Data

US 2008/0088561 A1 Apr. 17, 2008

(30) Foreign Application Priority Data

May 21, 2004 (JP) ..... 2004-152622

(51) Int. Cl.
*G09G 3/30* (2006.01)
*G09G 3/36* (2006.01)

(52) U.S. Cl. ..... 345/76; 345/100

(58) Field of Classification Search ..... 345/76, 345/77, 82, 83, 98, 100; 313/500, 504
See application file for complete search history.

(56) References Cited

U.S. PATENT DOCUMENTS

| | | | | |
|---|---|---|---|---|
| 5,151,689 | A * | 9/1992 | Kabuto et al. | 345/103 |
| 7,439,667 | B2 * | 10/2008 | Ohtani | 313/500 |
| 7,592,981 | B2 * | 9/2009 | Maeda | 345/76 |
| 2001/0048408 | A1 * | 12/2001 | Koyama et al. | 345/76 |

FOREIGN PATENT DOCUMENTS

| | | |
|---|---|---|
| JP | 02-253232 | 10/1990 |
| JP | 11-153982 | 6/1999 |
| JP | 2000-020029 | 1/2000 |

* cited by examiner

*Primary Examiner*—Kevin M Nguyen
(74) *Attorney, Agent, or Firm*—Morgan Lewis & Bockius LLP

(57) ABSTRACT

A display device includes an array having a plurality of pixel circuits arranged in a matrix, each pixel circuit includes a optoelectronic element and a plurality of thin-film transistors for controlling the optoelectronic element; data lines arranged to correspond to columns of pixel circuits for providing data signals to the pixel circuits; a data driver for driving the data lines; select lines for providing select signals for controlling the capture of data signals from the data lines to pixel circuits; and a select driver for driving the select lines including a shift register for sequentially shifting a line select signal, enable circuits for enabling outputs of the shift register, and n (where n is an integer of two or more) enable control lines for controlling the enable circuits, and the enable circuits are connected to the same one of the enable control lines every n lines.

13 Claims, 25 Drawing Sheets

| | ORDER | PULSE INTERVAL Pi(Tckv) | SUBFRAME PERIOD Ti(Tckv) | RATIO |
|---|---|---|---|---|
| SFO | 2 | 2 | 2+1/3 | 1 |
| SF1 | 3 | 5 | 4+1/3 | 1.86 |
| SF2 | 1 | 8 | 8+1/3 | 3.57 |
| SF3 | 2 | 16 | 16 | 6.86 |

| | ORDER | PULSE INTERVAL Pi(Tckv) | SUBFRAME PERIOD Ti(Tckv) | RATIO |
|---|---|---|---|---|
| SFO | 2 | 4 | 3+2/3 | 1 |
| SF1 | 1 | 7 | 7+2/3 | 2.09 |
| SF7-1 | 3 | 256 | 255+2/3 | 69.73 |
| SF2 | 2 | 16 | 15+2/3 | 4.27 |
| SF3 | 1 | 31 | 31+2/3 | 8.64 |
| SF7-2 | 3 | 256 | 255+2/3 | 69.73 |
| SF4 | 2 | 64 | 63+2/3 | 17.36 |
| SF5 | 1 | 127 | 127+2/3 | 34.82 |
| SF6 | 3 | 256 | 255+2/3 | 69.73 |

| | PULSE INTERVAL Pi(Tckv) | SUBFRAME PERIOD Ti(Tckv) | RATIO |
|---|---|---|---|
| SFO | 7 | 7.5 | 1 |
| SF1 | 15 | 15.5 | 2.067 |
| SF2 | 31 | 31.5 | 4.2 |
| SF3 | 63 | 63.5 | 8.467 |
| SF4 | 127 | 127.5 | 17 |
| SF5 | 240 | 240 | 32 |
| SF6 | 480 | 480 | 64 |
| SF7 | 960 | 960 | 128 |

FIG. 27

ACTIVE MATRIX DISPLAY DEVICE

FIELD OF THE INVENTION

The present invention relates to an active matrix-type display device for driving optoelectronic elements.

BACKGROUND OF THE INVENTION

In recent years, as information has become ubiquitous, it has become necessary for mobile information terminals to also have processing performance matching that of personal computers. In accompaniment with this, it is also demanded that image display devices have high-resolution and high picture quality, and it is desirable for such image display devices to be thin, be lightweight, be visible from wide angles, and have low power consumption.

In order to respond to such requirements, display devices (displays) have been developed where thin film active elements (thin film transistors, also referred to as TFTs) are formed on a glass substrate, with optoelectronic elements then being formed on top.

In the main, a substrate forming active elements is such that patterning and interconnects formed using metal are formed after forming a semiconductor film of amorphous silicon or polysilicon etc. Due to differences in the electrical characteristics of the active elements, the former requires ICs (Integrated Circuits) for drive use, and the latter is capable of forming circuits for drive use on the substrate.

With liquid crystal displays (Liquid Crystal Displays or simply LCDs) currently widely in use, the former amorphous crystal type is widespread for large-type screens, while the latter polysilicon type is common for medium and small-type screens.

Of self-luminous type screens, polysilicon type displays are the only electroluminescent (organic EL) displays characterized by being thin, light-weight and having a wide angle of visibility that are mass-produced.

Typically, organic EL elements are used in combination with TFTs and utilize this voltage/current control operation so that current is controlled. The current/voltage control operation referred to here refers to the operation of applying a voltage to a TFT gate terminal so as to control current between the source and drain. As a result of doing this it is possible to adjust the intensity of emitted light from the organic EL element and to display with the desired gradation.

However, because this configuration is adopted, the TFT characteristic is extremely sensitive to the influence of the intensity of light emitted by the organic EL element. In particular, for polysilicon TFTs formed using low-temperature processes referred to as low-temperature polysilicon, it can be confirmed that comparatively large differences in electrical characteristics occur between neighboring pixels. This is a major cause of deterioration of the display quality of organic EL displays, in particular, the uniformity of displaying within a screen.

Related art for improving this is disclosed in patent document 1. In patent document 1, the polysilicon TFTs driving the organic EL element are driven so as to be in one of two states, either lit-up, or extinguished (digital driving). This suppresses variations in the characteristics, and this enables gradation as a result of controlling this illumination period. Namely, in order to control the illumination period of the organic EL, a plurality of drive circuits capable of a plurality of scans are added.

In Japanese Patent Laid-open Publication No. 2002-29709 the number of polysilicon TFT circuits is increased because of, for example, adding a plurality of driver circuits constituted by polysilicon TFTs in order to achieve digital driving. The number of polysilicon TFT circuits is therefore increased, and the circuit failure rate therefore increases accordingly. In particular, a high-definition display panel will have a very large number of pixels and drive circuits, which will cause yield to fall and costs to increase.

It is therefore advantageous for the present invention to implement a high-quality organic EL display for which the number of circuits for digital driving is kept small and display uniformity is high.

SUMMARY OF THE INVENTION

In the present invention there is provided a display device comprising a display array having a plurality of pixel circuits being arranged in a matrix, wherein each pixel includes a optoelectronic element and a plurality of thin-film transistors for controlling the optoelectronic element, data lines arranged to correspond to columns of pixel circuits of the display array for providing data signals to the pixel circuits, a data driver for driving the data lines, select lines for providing select signals for controlling the capture of data signals from the data lines to pixel circuits and a select driver for driving the select lines, wherein the select driver comprises a shift register for sequentially shifting a line select signal, enable circuits for enabling outputs of the shift register, and n (where n is an integer of two or more) enable control lines for controlling the enable circuits, and the enable circuits are connected to the same one of the enable control lines every n lines.

Further, it is appropriate for the display array, the data driver, and the select driver to be formed on a single glass substrate.

Moreover, it is preferable for a period that the line select signal of the shift register is held in an address is divided by n, and over n respective divided periods, so that one of the n enable control lines that is not-yet enabled is selected and a corresponding select line is made active.

Still further, it is appropriate for the line select signal making the n or less select lines active to be inputted to the shift register in such a manner that the address of the shift register where the line select signal exists is divided by n, with the remainders all being different.

Further, the data driver may be comprised of a data bus for sending data for each pixel as digital data, a shift register for sequentially transferring a pulse controlling data transfer on the data bus, a first latch for taking for one line on the data bus in accordance with the pulse of the shift register and having a capacity capable of storing one bit data for one line, and a second latch for storing data for one line taken in at the first latch, and having a capacity capable of storing one bit data for one line. Here, at the nth period of the n periods that are the period divided by n, nth data on the select line selected at the nth period is outputted.

Further, it is preferable for the thin-film transistors controlling the optoelectronic element are accessed a plurality of times in one frame period by the select driver and the data driver, and ratios of the accessed periods from one access to re-accessing becomes $1:2:2^2:2^3:\ldots:2^n$.

Moreover, the pixel circuits may be such that a pair of pixel circuits neighboring each other in the horizontal scanning direction are connected to the same data line, with neighboring pixel circuits connected to the same data line being connected to different select lines, and the enable circuits of the select driver have sets of two pair enable control lines per one horizontal line for enabling outputs of the shift registers, with neighboring pixel circuits connected to the same data line being enabled separately.

It is also desirable for the pixel circuits to generate four arbitrary colors of R, G, B and X, and X is one of R, G and B, or white.

In the present invention there is provided a display device with optoelectronic elements, a display array having a plurality of pixel circuits being arranged in a matrix, wherein each pixel includes a optoelectronic element and a plurality of thin-film transistors for controlling the optoelectronic element, data lines arranged to correspond to columns of the pixel circuits of the display array for providing data signals to each pixel circuit, a data driver for driving the data lines, select lines for providing select signals for controlling the capture of data signals from the data lines at each pixel circuit, and a select driver for driving the select lines, wherein the select driver comprise shift registers for sequentially shifting line select signals, enable circuits for enabling outputs of the shift registers, and two enable control lines for controlling the enable circuits, and the enable circuit is connected to the same one line of one of the two enable control lines separately for odd-numbered horizontal lines and even-numbered horizontal lines.

Further, it is preferable for the period where the line select signal of the shift register is held in same address to be divided into two, so that in the first period one of the two enable control lines is selected and a corresponding select line is made active, and in the second period, the remaining one is selected, and a corresponding select line is made active.

Moreover, it is preferable for the line input signal making the 2 or less select lines inputted to the shift register active to be inputted in such a manner that the address of the shift register where the line select signal exists is different for odd numbers and even numbers.

Further, the data driver may be comprised of a data bus for sending data for each pixel as digital data, a shift register for sequentially transferring a pulse controlling data transfer on the data bus, a first latch for taking data for one line on the data bus in accordance with the pulse of the shift register and having a capacity capable of storing one bit data for one line, and a second latch for storing data for one line portion taken in at the first latch, and having a capacity capable of storing one bit data for one line. Here, in the first period of the period divided by two, first data is outputted for select lines selected in the first period, and in the second period, extinguishing data is outputted for the select lines selected in the second period.

Moreover, the pixel circuits may be such that a pair of pixel circuits neighboring each other in the horizontal scanning direction are connected to the same data line, with neighboring pixel circuits connected to the same data line being connected to different select lines, and the enable circuits of the select drivers may have sets of two pair enable control lines per one horizontal line for enabling outputs of the shift registers, with neighboring pixel circuits connected to the same data line being enabled separately.

According to the present invention, it is possible to perform digital driving without increasing circuit scale, and it is possible to realize an organic EL display with superior display uniformity.

BRIEF DESCRIPTION OF THE DRAWINGS

FIG. 27 is a view showing an eight-bit digital drive timing setting table of the third embodiment;

DESCRIPTION OF THE PREFERRED EMBODIMENTS

The following is a detailed description of the embodiments of the present invention.

FIRST EMBODIMENT

Figure 1:
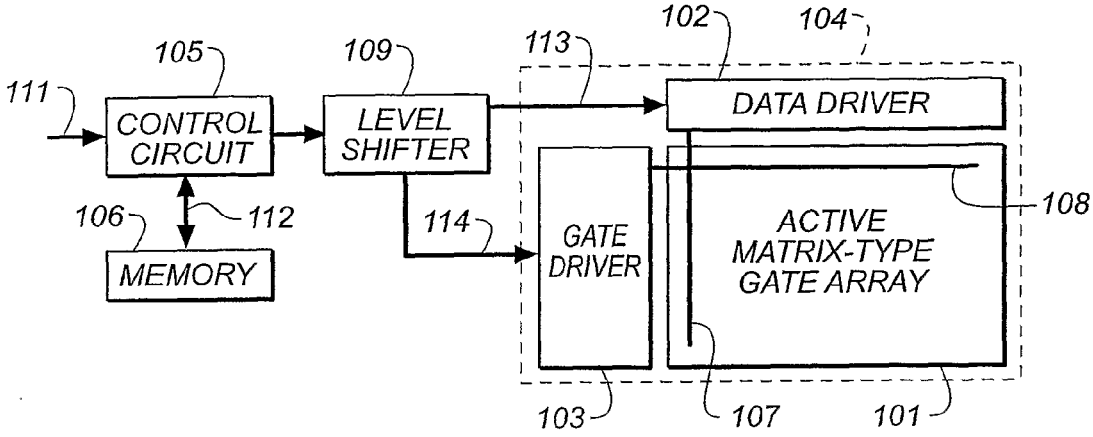
FIG. 1 is a view of an overall configuration for a first embodiment.

First, an overall configuration of the first embodiment of the present invention is described using FIG. 1.

FIG. 1 is a view showing an overall structure of an organic EL display device of the present invention. Numeral 101 represents an active matrix display array where each pixel is arranged in a matrix, numeral 102 represents a data driver for driving data lines 107 (these are arranged according to the number of pixels in the horizontal scanning direction but only one line is shown) of the display array 101, and numeral 103 represents a select driver (hereinafter referred to as a gate driver) for driving select lines (hereinafter referred to as gate lines) 108 (arranged according to the number of pixels in the vertical scanning direction although only one line is shown here). When this is constructed using polysilicon TFTs, circuit 101 to circuit 103 are all formed on a glass substrate so as to constitute the display device 104.

Numeral 105 is a control circuit for providing control signals and data to the data driver 102 and gate driver 103 within the display device 104 and supplies control signals and data to the display device 104 via a data signal bus 113 and a gate signal bus 114. The control circuit 105 carries out prescribed level conversion via the level shifter 109 as necessary and supplies signals to the data signal bus 113 and gate signal bus 114.

Numeral 106 is a frame memory for use in implementing digital driving for exchanging data with the control circuit 105 via a memory bus 112. Basically, one frame portion of data is stored at the frame memory 106. Numeral 111 represents an input signal bus for transmitting image data and synchronization signals from outside.

The control circuit 105 and the frame memory 106 can also be made of individual ICs but this requires a certain degree of bus width for the memory bus 112, increases the number of pins for the control circuit 105, increases the mounting surface area and also causes costs and power consumption to rise. It is therefore also possible to build the frame memory into the control circuit as an SoC (System On Chip) and use this as a single IC. Alternatively, the control circuit 105 and the frame memory 106 (and further, 109) may also be encapsulated in a single package to give an SiP (System In Package) with the memory bus 112 then being housed within the package so as to reduce the mounting surface area and thereby reduce increases in the number of external pins and the power consumption.

Currently, ICs are provided where RAM referred to as RAM-built-in drivers is incorporated within the data driver at an IC for liquid crystal display use. It is therefore desirable to include the frame memory 106 within the data driver 102 in accompaniment with this.

Figure 2:
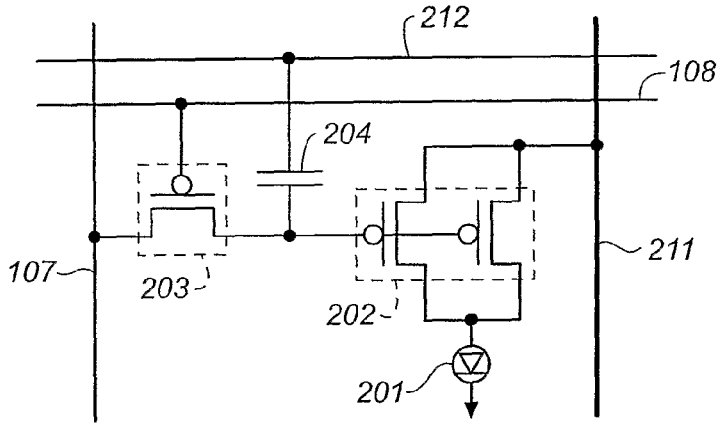
FIG. 2 is a view showing a polysilicon TFT pixel circuit.

Next, the pixels circuits that are arranged in a matrix are described using FIG. 2. A pixel circuit arranged at the display array 101 is shown in FIG. 2. Numeral 201 is an organic EL element with an anode terminal connected to the TFT side. The organic EL element 201 may employ a full color method such as a method using R-light-emitting material in R pixels, G-light-emitting material in G pixels, and B-light-emitting material in B-pixels, or a method dispersing light using a color filter, or may be a bottom emitter type where light emission is derived from the anode side, or a top emitter type where light emission is derived from the cathode side but the present invention is by no means limited in this respect. Numeral 202 represents a drive TFT for digitally controlling current flowing in the organic EL element 201, with two being arranged in parallel in FIG. 2.

In FIG. 2, the reason two TFTs are arranged in parallel at the drive TFT 201 is to give a redundant construction where, in the event that electrical characteristics change at the electrodes of one transistor due to imperfections in construction, for example, if the event of the on current dropping etc. is assumed, it is still possible for the other TFT to operate to a certain extent. It is also possible to use more than two TFTs. However, if cases where increase in leakage current due to imperfect construction are common, it may be preferable to use only one TFT, and in the event of a high-definition display, the object is to make the aperture ratio large, and it is therefore preferable to make the number of TFTs small.

A source terminal electrode of the TFT 202 is connected to a current supply line 211, and a drain terminal electrode of the TFT 202 is connected to the anode of the organic EL element. The gate terminal electrode of the TFT 202 is connected to one terminal electrode of a hold capacitor 204, and another terminal electrode of the hold capacitor 204 is connected to a reference potential line 212. As a result, a switch operation of the TFT 202 is decided by the voltage level written to the hold capacitor 204.

Numeral 203 is a gate TFT for data writing, having a gate terminal connected to gate line 108, a drain terminal connected to data line 107, and a source terminal connected to hold capacitor 204 and the gate terminal of TFT 202.

The current supply line 211, cathode terminal of the organic EL terminal, and reference potential line 212 are shared by all of the pixels.

The TFTs shown in FIG. 2 are all p-channel TFTs but may also be partially or entirely n-channel TFTs.

Figure 4:
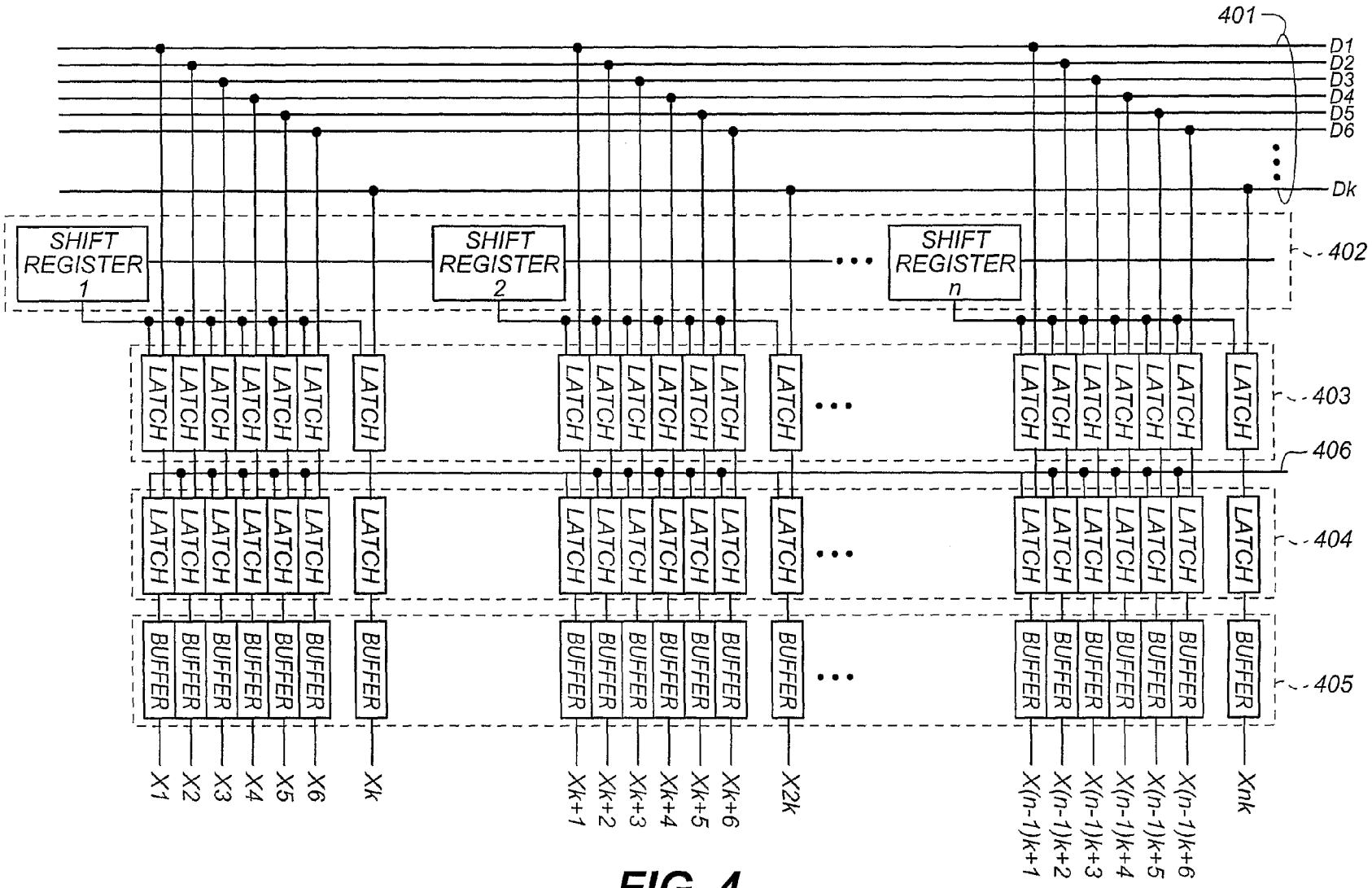
FIG. 4 is a view of a configuration of a data driver.

Next, the internal configuration and operation of the data driver 102 of the present invention is described using FIG. 4. Numeral 401 is a data bus, numeral 402 is a shift register, numeral 403 is a first data latch for latching one bit of data on the data bus, numeral 404 is a second data latch for collectively latching one line of data for the first data latch, and numeral 405 is a buffer for driving the data line 107 using the data of the second data latch. Further, numeral 406 is a control signal line for collectively transmitting data of the first data latch to the second data latch.

In the event of digital driving, data for one pixel is transmitted using one data bus 401 because each data line 107 is only driven at two voltage levels in the event of digital driving. For example, when there are twenty-four data buses, if one pixel adopts the three colors of RGB, it is possible to transmit an eight-pixel portion at one time.

Data on the database 401 is sequentially transferred to the first data latch 403 using a sequentially shifting clock of the shift register with data for one line portion being held. Namely, data on the data line 401 is latched to a location corresponding to the first data latch 403 by sequentially transferring the select signal at the shift register 402. During this time, data of the first data latch 403 is not reflected at the second data latch 404. The data of the first data latch 403 is loaded at the second data latch 404 so that latching of the first data is opened by putting a data transfer signal line 406 to active at the time that the data latching operation for the first line portion is complete. The buffer 405 then drives the data line 107 using data for one line portion of the second data latch 404.

During this time, the opened first data latch 403 sequentially holds data for the next line again due to the shift register clock, and data is transferred to the second data latch 404. These operations are then repeated for the horizontal lines for the whole display in the vertical scanning direction so that a display operation for one screen is complete.

Figure 5:
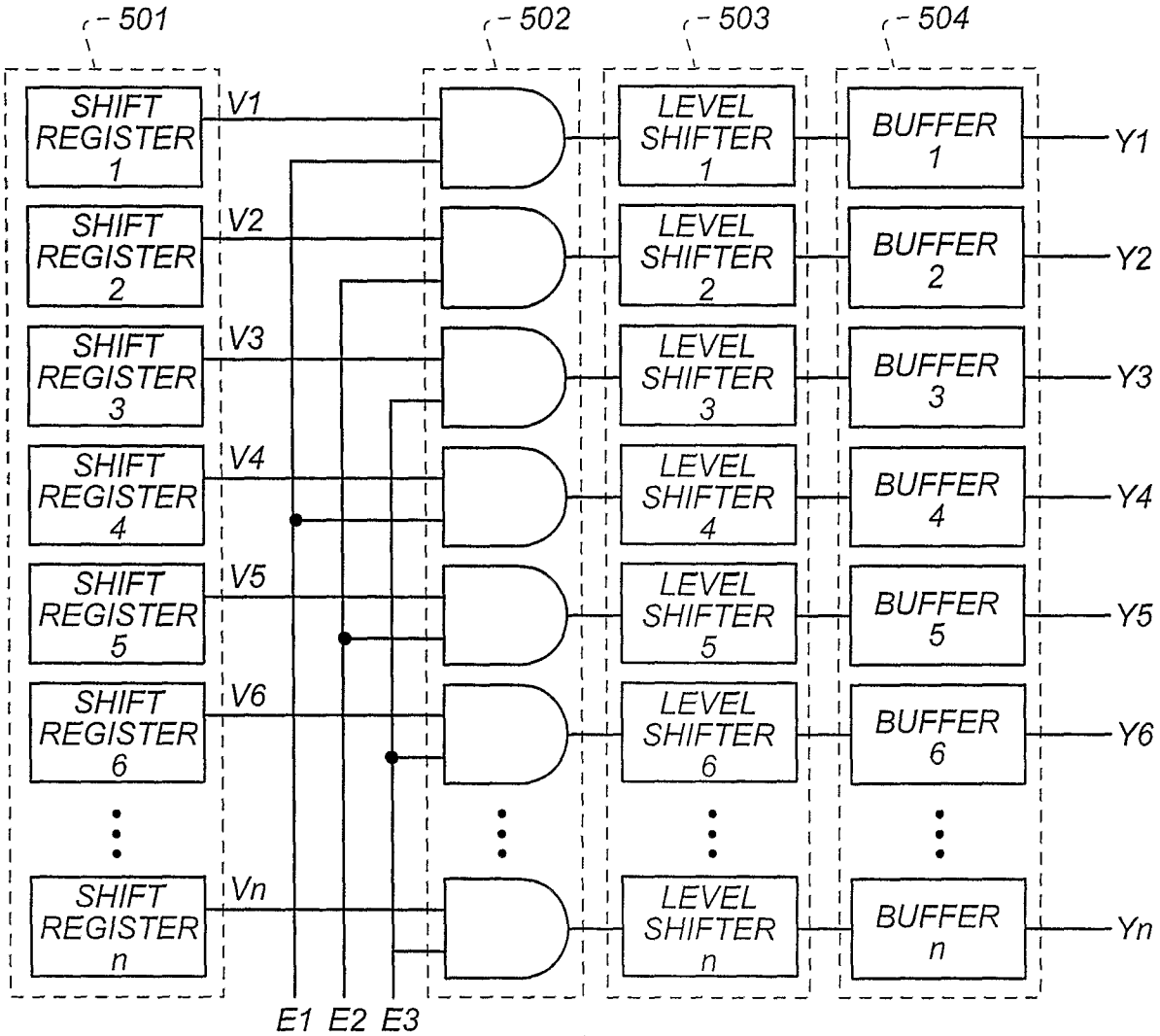
FIG. 5 is a gate driver configuration view for a first embodiment.

Next, the internal configuration and operation of the gate driver 103 of the present invention is described using FIG. 5. Numeral 501 is a shift register, numeral 502 is an enable circuit, numeral 503 is a level shifter, and numeral 504 is a buffer. V1 to Vn are outputs of the shift register 501, and E1 to E3 enable control lines.

An output of the shift register is inputted to one of the inputs of the enable circuit 502, and another input is connected to one of the three enable control lines E1 to E3. Namely, as shown in FIG. 5, enable circuits connected to outputs V1, V4, . . . , V3*(i−2) (where I is a natural number) are connected to enable control line E1, enable circuits connected to V2, V5, . . . , V3*(i−1) are connected to enable control line E2, and enable circuits connected to V3, V6, . . . , V3*i are connected to enable control line E3.

Shift register 501 is shifted by taking an input pulse as a clock, and outputs a shift pulse at output Vi. This outputted shift pulse is then activated by enable circuit 502 controlled by one of the enable control lines E1 to E3 so as to reflect the next level shifter 503.

The level shifter 503 converts the signal level of the shift register 501 to a signal level appropriate for driving the gate line. The buffer 504 buffers the signal level of the level shifter 503 so as to put the gate line active by outputting this signal level to the gate line, so as to control writing of data to a pixel.

In this embodiment there are three enable control lines E1 to E3, but this is by no means limiting, and there may also be four lines.

Figure 6:
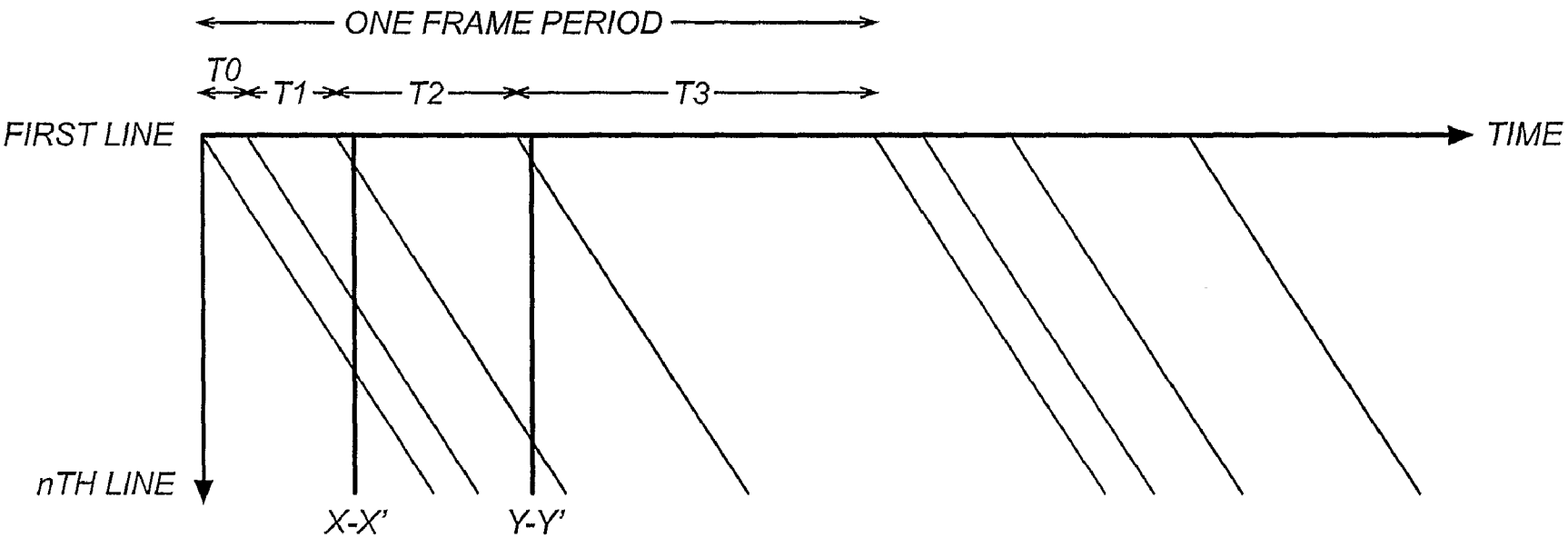
FIG. 6 is a view showing a four-bit digital drive scanning sequence of the first embodiment.

The gradation generating process for digital driving is now described using FIG. 6. FIG. 6 shows a drive sequence for digital driving at an active matrix-type display, with the horizontal axis showing time, and the vertical axis showing horizontal scanning lines. FIG. 6 gives an example of four-bit, sixteen gradation digital driving for ease of description.

In digital driving, one frame period is divided into a plurality of sub-frames SF0 to SFn, with a display period weighted so as to correspond to bit data being allotted to each subframe period. T0 to T3 shown in FIG. 6 show each subframe period, with each subframe period respectively corresponding to bit data D0 to D3. When bits D0 to D3 are "1", the corresponding sub-frames SF0 to SF3 are illuminated for the corresponding periods T0 to T3, and when the bits for D0 to D3 are "0", the corresponding sub-frames SF0 to SF3 are extinguished for the periods T0 to T3.

The illumination periods are therefore controlled so as to give, approximately, T0:T1:T2:T3=1:2:4:8. A four-bit, 16 gradation display is then possible by performing control in this manner. It is also possible to apply this to the event of implementing higher resolution using six bits or eight bits.

In the digital driving of the present invention, sections exist where two lines or more are selected, as typified by X-X' and Y-Y' of FIG. 6. Although described in detail later, an appropriate subframe configuration is applied according to the resolution and number of gradations of the display in order to enable driving using the gate driver of FIG. 5.

Figure 7:
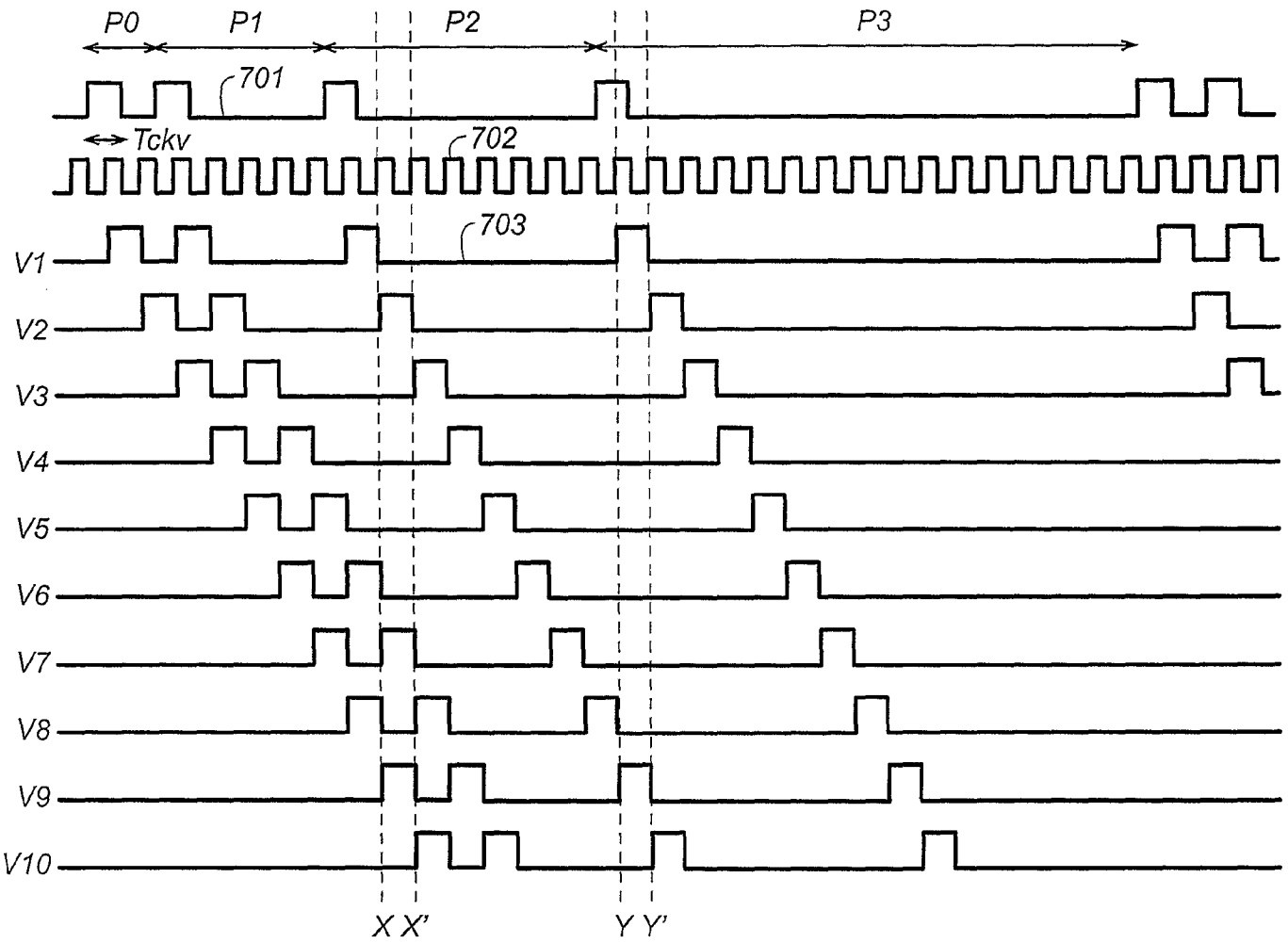
FIG. 7 is a view showing a four-bit digital drive timing chart of the first embodiment.

FIG. 7 is an enlarged partial view of section XX' of FIG. 6. A ten-line display is considered for ease of description.

Numeral 701 is an input pulse inputted to the shift register of the gate driver 103, and numeral 702 is a clock for shifting data of the shift register. In FIG. 7, the case is shown where the input pulse 701 is read into the shift register on the rising edge of the clock 702. Numeral 703 is the output V1 of the shift register of the first stage. This pulse is sequentially shifted by each shift register due to the shift clock 702, so that pulses are outputted at each output Vi (where i=1 to 10).

The input pulse 701 takes the pulse intervals to be P0=2*Tckv, P1=5*Tckv, P2=8*Tckv, P3=16*Tckv. Where Tckv is the clock period of 702. Paying attention to the section XX', in this period, the shift register outputs V2, V7, and V9 are "High". However, as shown for the configuration of the gate driver of FIG. 5, V2 is enabled by enable control line E2, V7 is enabled by enable control line E1, and V9 is enabled by enable control line E3. The gate lines of the second line, seventh line and ninth line can therefore be selected in a time-divided manner.

Figure 8:
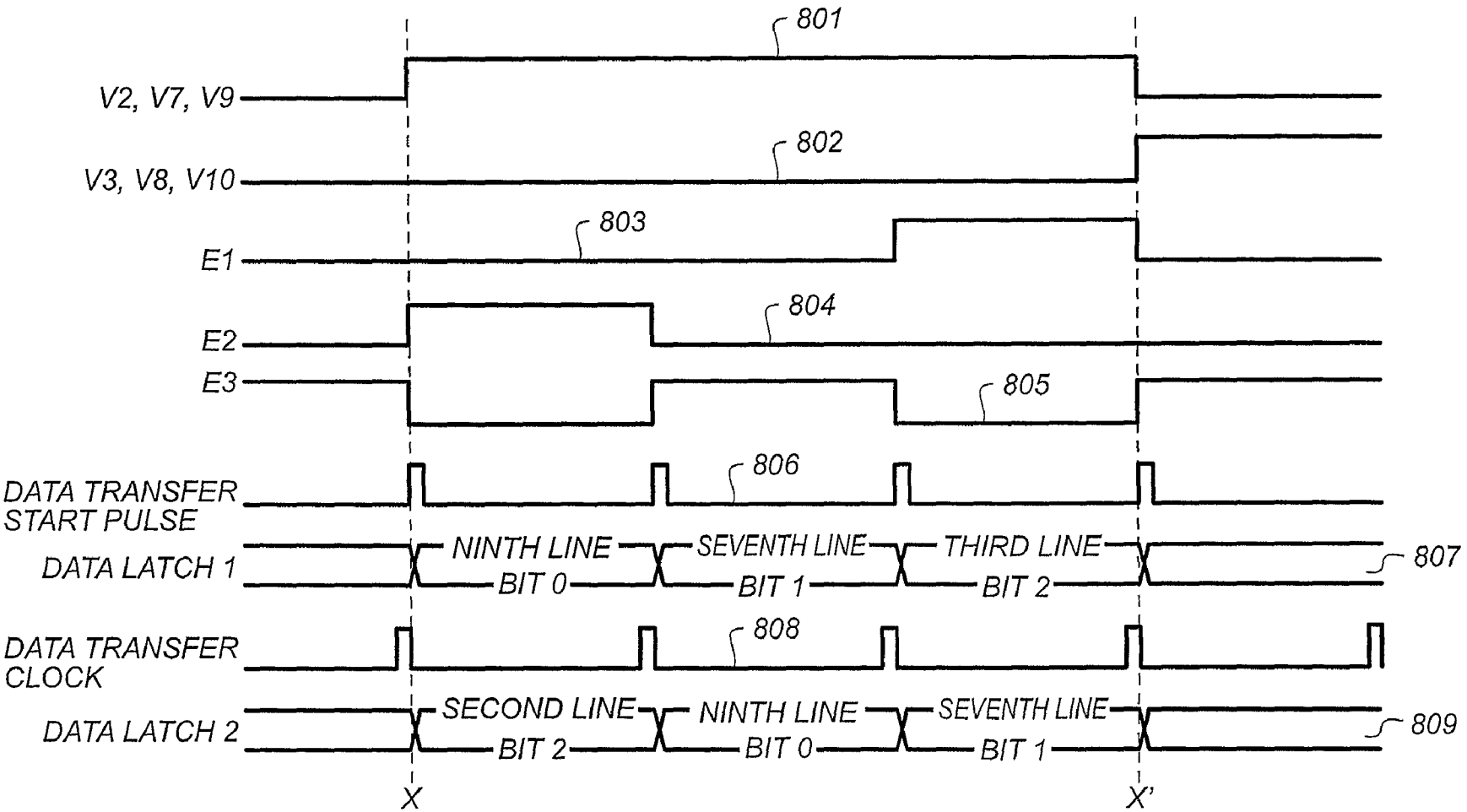
FIG. 8 is a view showing a four-bit digital drive enable timing chart 1 of the first embodiment.

FIG. 8 is a timing chart further expanded for section XX' of FIG. 7 in a localized manner.

Here, numeral 801 is a shift register output, and V2, V7 and V9 are output pulses. Numeral 802 is an output pulse for V3, V8 and V10. Numeral 803 is a pulse for E1, numeral 804 is a pulse for E2, and numeral 805 is a pulse for E3. Numeral 806 is a data transfer start pulse inputted to the shift register 402 of the data driver 102, and is used to sequentially latch data on the data bus 401 to the first data latch 403. Numeral 807 is data for the first data latch 403, numeral 808 is a clock for transferring data of the first data latch 403 to the second data latch 404, and numeral 809 is data of the second data latch 404.

In the period for the first third of XX' divided into three, E1 is "Low", E2 is "High", and E3 is "Low". The output V2 is therefore activated by the enable circuit, and the gate line of the second line is made active. The data of the second data latch 404 is data for bit 2 of the second line at this timing. This data is then written to the pixel of the second line, displaying of the subframe 1 is ended, and displaying of subframe 2 is commenced.

At the second section, E1 is "Low", E2 is "Low", and E3 is "High". The output V9 is therefore activated by the enable circuit, and the gate line of the ninth line is made active. The data of the second data latch 404 is data for bit 0 of the ninth line at this timing. This data is then written to the pixel of the ninth line, display of the subframe 3 is ended, and displaying of subframe 0 is commenced.

At the final section, E1 is "High", E2 is "Low", and E3 is "Low". The output V7 is therefore activated by the enable circuit, and the gate line of the seventh line is made active. The data of the second data latch 404 is data for bit 1 of the seventh line at this timing. This data is then written to the pixel of the seventh line, displaying of the subframe 0 is ended, and displaying of subframe 1 is commenced.

Figure 9:
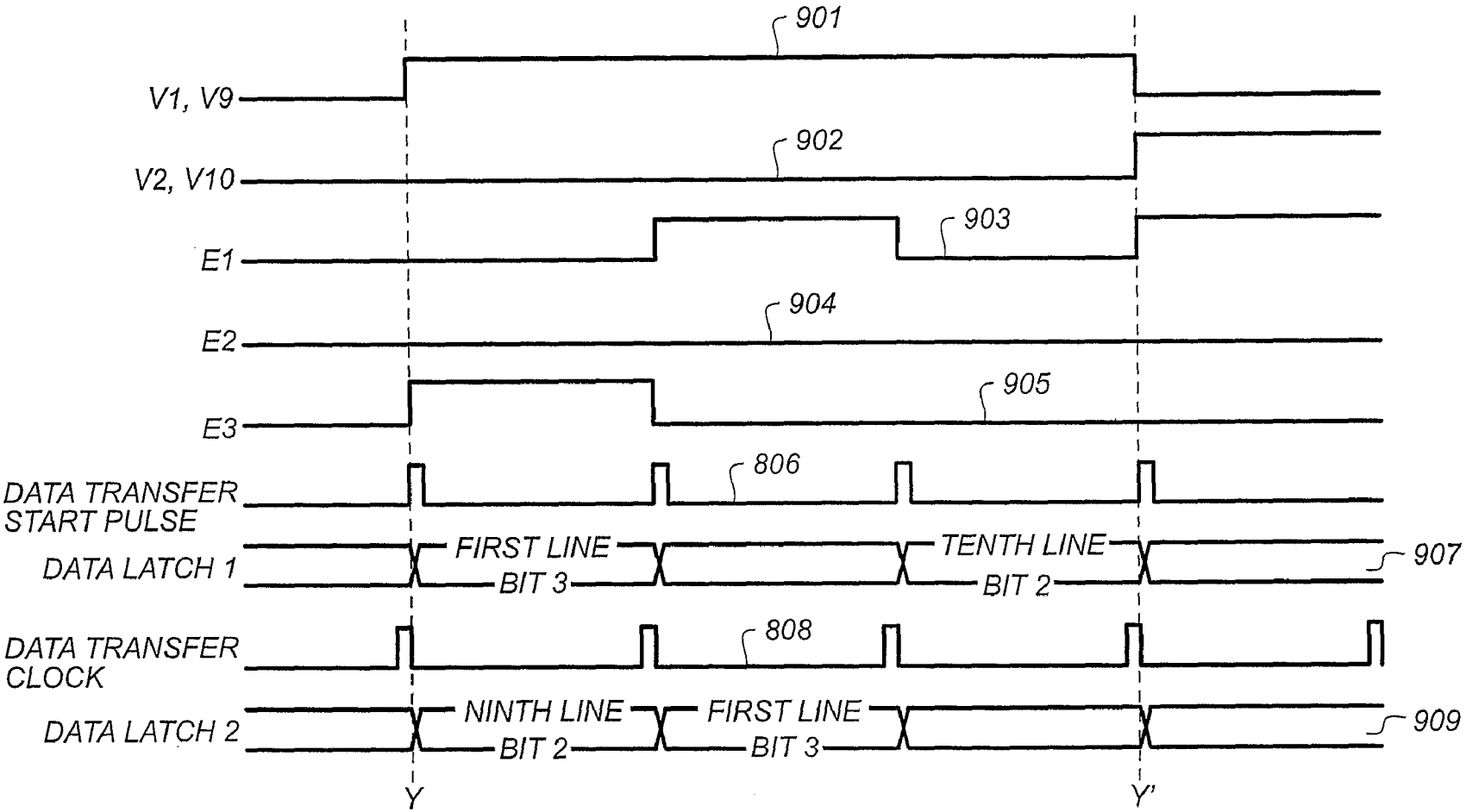
FIG. 9 is a view showing a four-bit digital drive enable timing chart 2 of the first embodiment.

FIG. 9 is an enlarged partial view of section YY' of FIG. 7, where numeral 901 is the output pulse for V1 and V9, numeral 902 is the output pulse for V2 and V10, numerals 903, 904 and 905 are enable signals for E1, E2 and E3 respectively, numeral 907 is the first data latch 403, and numeral 909 is data for the second data latch 404.

At the first section of YY' divided into three, E1 is "Low", E2 is "Low", and E3 is "High". The output V9 is therefore activated by the enable circuit, and the gate line of the ninth line is made active. The data of the second data latch 404 is data for bit 2 of the ninth line at this timing. This data is then written to the pixel of the ninth line, displaying of the subframe 1 is ended, and displaying of subframe 2 is commenced.

At the next section, E1 is "High", E2 is "Low", and E3 is "Low". The output V1 is therefore activated by the enable circuit, and the gate line of the first line is made active. The data of the second data latch 404 is data for bit 3 of the first line at this timing. This data is then written to the pixel of the first line, displaying of the subframe 2 is ended, and displaying of subframe 3 is commenced.

At the next section, none of the gate lines become active because none of E1 to E3 are "High".

Figures 10, 11:
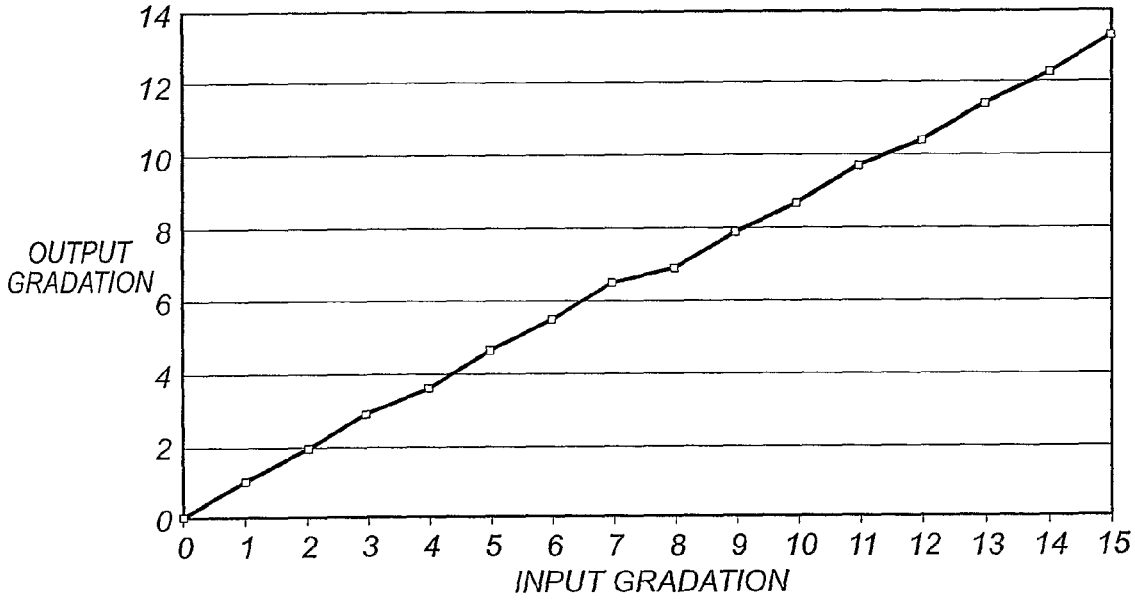
FIG. 10 is a view showing a four-bit digital drive timing setting table of the first embodiment.
FIG. 11 is a view showing a four-bit digital drive input/output gradation characteristic of the first embodiment.

The pulse intervals P0 to P3 and the sequence of writing data at the section divided by three is shown in FIG. 10. The pulse intervals P0 to P3 and the data writing sequence are by no means limited to that shown in FIG. 10.

It is, however, necessary to take into consideration the fact that the ratio of T0 to T3 gives better continuity when closer to the target value. For example, referring to FIG. 10, in the event that a pulse interval P0 of "2" and pulse interval P1 of "5" are decided upon, then a balance of T0:T1=1:2 is not maintained. It is therefore preferable to decide upon an order where SF1 starts as late as possible and finishes as early as possible.

Namely, in the period divided into three for writing SF0 to SF2, for example, at XX', it is preferable to decide to write bit 1 data of SF1 last and to write bit 2 data of SF2 first, with the remaining SF0 being written second. As a result, displaying of T1(SF0) is started at the end of the period divided into three, and T1 becomes=(P1−1+⅓)*Tckv from the end of displaying the start of the next subframe (at the start of SF2).

As a result of deciding this, the subframe period and the ratio thereof become as shown in FIG. 10, so that when 16 gradation displaying is carried out in the subframe period of FIG. 10, a relationship for the input gradation and the output gradation as shown in FIG. 11 is obtained.

Figure 12:
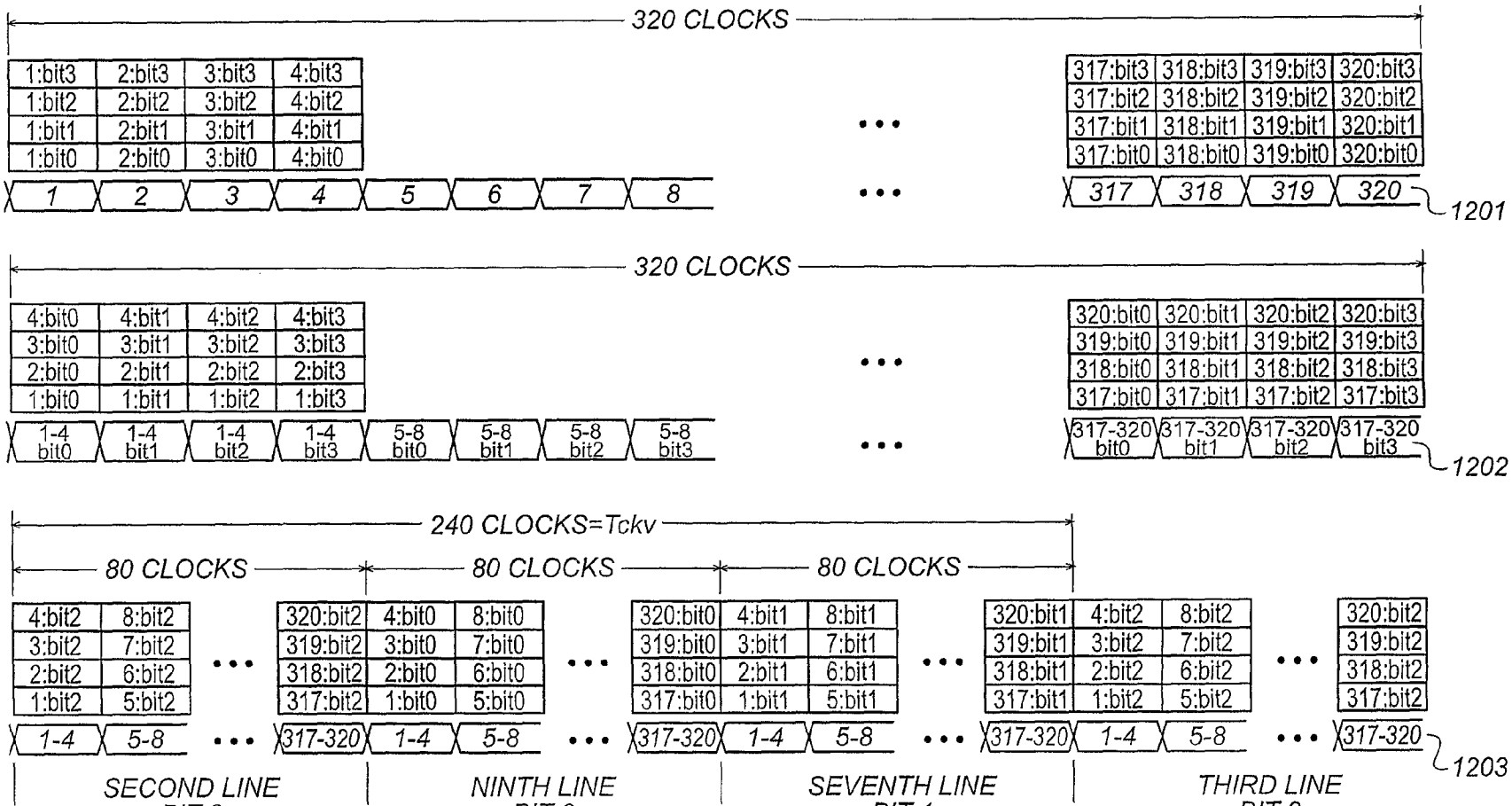
FIG. 12 is a view illustrating control circuit data processing.

Next, using FIG. 12, in order to hold data at the second latch at the timing shown in FIG. 8 and FIG. 9, the frame memory 106 is controlled, and a description is given of timing for processing data processed by the data control circuit 105. FIG. 12 shows data processing timing when driving a display of horizontal resolution of, for example, 320 to display at four-bit gradation.

Numeral 1201 is four-bit input gradation data inputted from the input bus 111, numeral 1202 is digital drive format data generated by the control circuit 105 and written to the frame memory 106, and numeral 1203 is digital drive format data read from the frame memory 106.

In the event that image data inputted from the input bus 111 is for a full-color display, three channels exist for RGB but as the operation is the same for either of R, G and B only one is shown in FIG. 12.

The four-bit input data 1201 is taken as a single block of a continuous four pixels by the data processing circuit 105 and is converted to a digital drive format for transfer in order from bit 0 to bit 3. Namely, four-bit input data for pixel 1 to pixel 4 is converted to four bits of data constituted only by bit 0 for pixel 1 to pixel 4, data constituted only by bit 1, data constituted only by bit 2, and data 1202 constituted only by bit 3, for writing to the frame memory 106.

In this event, as one line it taken to be 320 pixels, one line of data is written to the frame memory using 320 clocks.

When data is temporarily written to the frame memory, it is possible to access all of the line data by designating the address of the frame memory. After accessing data for the second line as shown in FIG. 8 and FIG. 9, skip reading can take place arbitrarily of, for example, data for the ninth line and data for the seventh line.

Two frame memory systems are provided because it is necessary to convert image data for the next frame to the same format and write this image data when carrying out reading.

The read data 1203 is generated by first reading 320 pixels from bit 2 of the second line on eighty clocks, and bit 0 of the ninth line and bit 1 of the seventh line are then similarly read out in order. Tckv is therefore 240 clocks in this case.

As shown in the timing chart of FIG. 8, when the data transfer start pulse 806 is inputted to the first stage of the shift register 402, data for bit 2 of the second line of the data 1203 read out at the same time is transferred onto what in this case is, for example, a four line data bus 401. A pulse (=H level) is transferred in the shift register in accordance with the shift pulse provided to the shift register. Data for bit 2 of the second line on the data bus 402 is transferred to the first data latch selected by the register storing H level in the shift register.

The shift pulse extends to the final stage, and when transfer of one line portion of data for bit 2 of the second line to the first data latch is complete, a data transfer clock 808 is inputted to the data transfer signal line 406, and the data of the first data latch 403 is collectively transferred to the second data latch 404. The buffer 405 continues driving the data line 107 using the data of the second data latch 404 until the following data is transferred to the second data latch. During this time, a data transfer start pulse 806 is re-input to the shift register, and data for bit 0 of the ninth line is transferred in order on the shift pulse to the first data latch 403. When the shift pulse extends as far as the shift register of the final stage so that transfer or data for bit 0 of the ninth line to the first data latch is complete, a data transfer clock 808 is re-inputted to the data transfer signal line 406, and data for bit 0 of the ninth line on the first data latch is transferred to the second data latch. Data for the bit 1 of the seventh line is also provided as bit data to the data line by repeating a similar procedure.

Even if the input data is four bit data, it is not always necessary for the data bus 401 to have four lines, and the number of lines may be arbitrary. For example, if eight lines are adopted, it is possible to transfer eight pixel portions using one clock so that it is therefore possible to transfer one line portion using forty clocks, and the transfer period can therefore be made short.

Further, the periods of a clock for writing to the frame memory 305 and a clock for reading from the frame memory 305 may also be different. For example, the transfer period can be made shorter if the read clock is made faster.

In the above, an example is shown of four-bit, 16 gradation displaying, but in reality displays used in mobile information terminals etc. are six to eight bits, i.e. 64 to 256 gradation displaying is demanded. The drive method described above can also be applied at the time of high-definition displaying. An example is now described of eight-bit, 256 gradation driving taking the configuration of the data driver 102 and the gate driver 103 to be the same.

With eight bit, 256 gradation displaying, T0 is set to T1 . . . :, and T7 is set to 1:2 . . . :128, and it is necessary to cater for subframes of short emission periods to subframes of long emission periods. As shown in FIG. 6, when subframes are displayed in order from SF0 to SF7, in short subframes, the pulse intervals of the input pulse inputted to the shift register of the gate driver are shorter than those in long subframes, and a larger number of enable control lines are therefore necessary for selecting gate lines in a time-divided manner. Further, the illumination period of long subframes has a low frequency and this may easily become the cause of flickering.

Figures 13, 14:
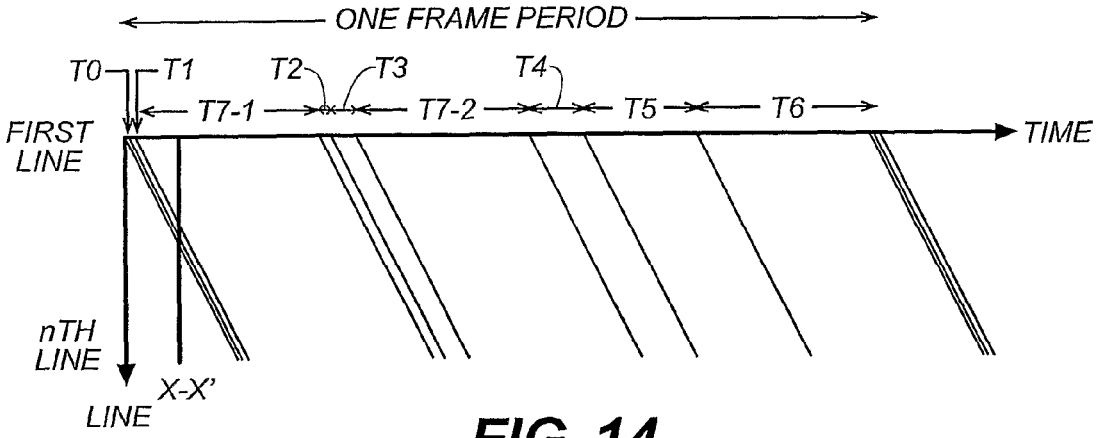
FIG. 13 is a view showing an eight-bit digital drive timing setting table of the first embodiment.
FIG. 14 is a view showing an eight-bit digital drive scanning sequence of the first embodiment.

The pulse intervals P0 to P7 are set as shown in FIG. 13. Here, SF7-1 and SF7-2 are pulse sections P7-1 and P7-2 respectively resulting from, for example, uniformly dividing the pulse section for SF7 in order to perform digital driving using three enable control lines.

The two pulse sections for P7 correspond to bit data 7, and the data for P7-1 and P7-2 therefore matches.

In FIG. 14, the horizontal axis is taken as time, and the vertical axis is taken as lines, so that subframe 7 is shown divided into two eight-bit, 256 gradation drive sequences.

For example, consider a panel with gate lines 1 to 240. At the time XX' in FIG. 14 where a 100th line is provided as a gate line for writing data for subframe 0, from FIG. 13, the gate line for writing the subframe 1 is the 96th line for four pulses previous, and the gate line for writing the subframe 7-1 is the 89th line for 4+7=11 pulses previous. The gate lines for writing thereafter then become 4+7+256=267>240, and therefore is not present within the screen. Namely, the number of gate lines for writing present within the screen is controlled to be three or less.

Figure 15:
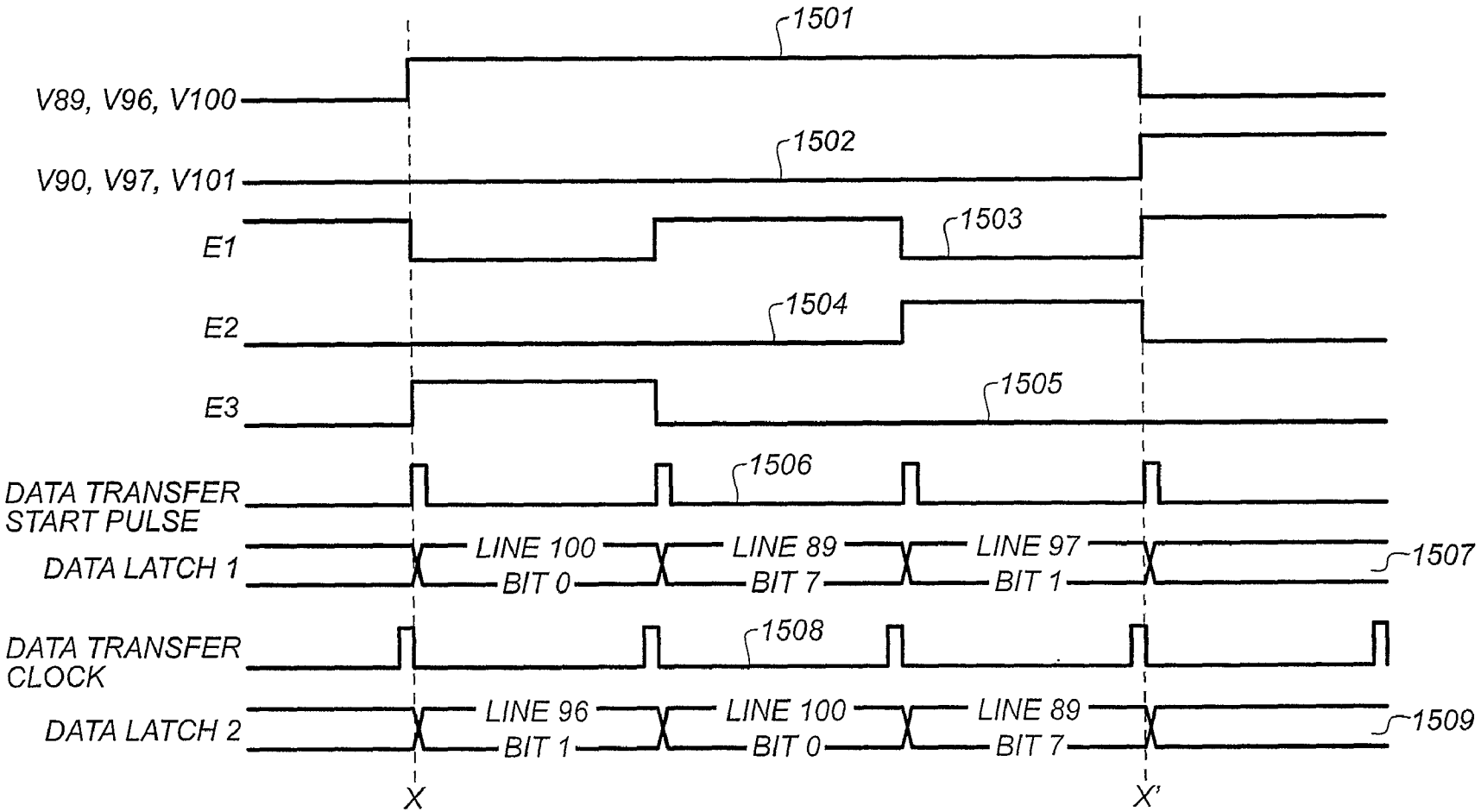
FIG. 15 is a view showing an eight-bit digital drive enable timing chart of the first embodiment.

An enlarged partial view of the section XX' is shown in FIG. 15, and is used to described a time-dividing selection sequence occurring at section XX' of the hundredth line.

Numeral 1501 is an output pulse for shift register outputs V89, V96 and V100, numeral 1502 is an output pulse for shift register outputs V90, V97 and V101, numeral 1503, 1504 and 1505 are enable pulses for enable control lines E1, E2 and E3 respectively, numeral 1506 is a pulse for starting transmission of data to the first data latch 403, numeral 1507 is data for the first data latch 403, numeral 1508 is a clock for transferring data of the first data latch 403 to the second data latch 404, and numeral 1509 is data for the second data latch 404.

In the first period of the "High" period of output pulses V89, V96 and V100 of the shift register divided into three, E1 is "Low", E2 is "Low", and E3 is "High". The signal of V96 is therefore activated by the enable circuit connected to E3 and the gate line of the 96th line is put to active. This data is read into the pixels of the 96th line in order to hold data for bit 1 of line 96 at the second latch 404 at this timing, and this displaying is carried out for the period of T1.

In the second period, E1 is "High", E2 is "Low" and E3 is "Low". The signal of V100 is therefore made active by the enable circuit connected to E1 and the gate line of the 100th line is made active. This data is written into the pixels of the 100th line in order to store data for bit 0 of line 100 at the second data latch 404 at this timing, and this displaying is carried out for the period of T0.

In the final period, E1 is "Low", E2 is "High" and E3 is "Low". The signal of V89 is therefore made active by the enable circuit connected to E2 and the gate line of the 89th line is made active. This data is read into the pixels of the 89th line in order to store data for bit 7 of line 89 at the second latch 404 at this timing, and this displaying is carried out for the period of T7-1.

Figure 16:
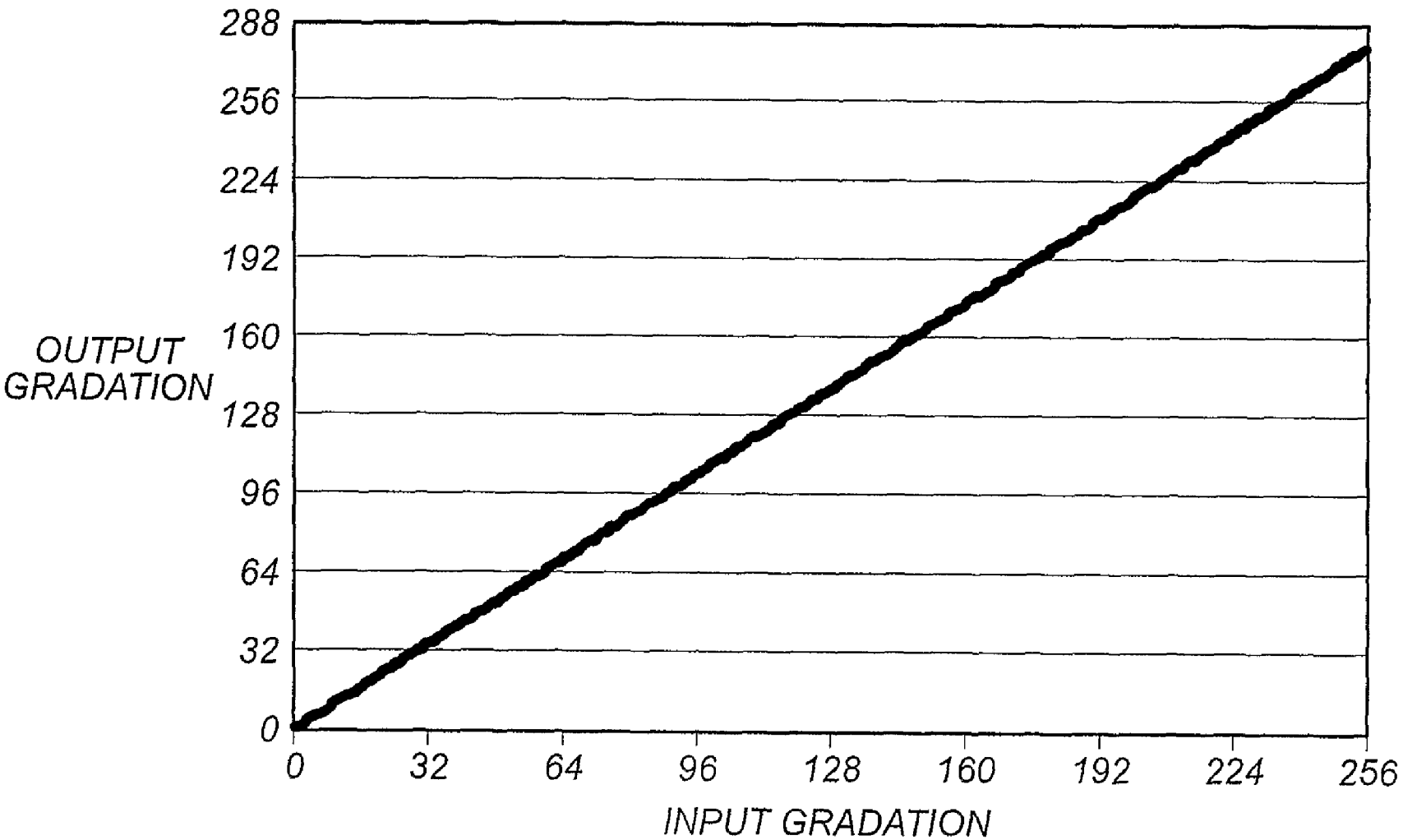
FIG. 16 is a view showing an eight-bit digital drive input/output characteristic of the first embodiment.

According to FIG. 13, the same control is possible even in the event of time division selection outside of the section X-X' because the sum of the pulse intervals for three consecutive subframes always exceeds 240 lines. It is not necessary to limit the pulse intervals and the write procedure in the period divided into three to that of FIG. 13, but it is preferable for the ratio of T0 to T7 to be as close as possible to the target value. FIG. 13 shows the procedure for writing in the period divided into three as shown in the example of four-bit, sixteen gradation displaying. The characteristics for input gradation and output gradation shown in FIG. 16 are obtained when 256 gradation displaying is carried out in the subframe period of FIG. 13.

It is therefore possible to implement eight-bit, 256 gradation digital driving without increasing the circuit scale by setting the pulse interval and period divided into three in this manner. This is extremely advantageous in implementing higher-definition organic EL displays.

Figure 17:
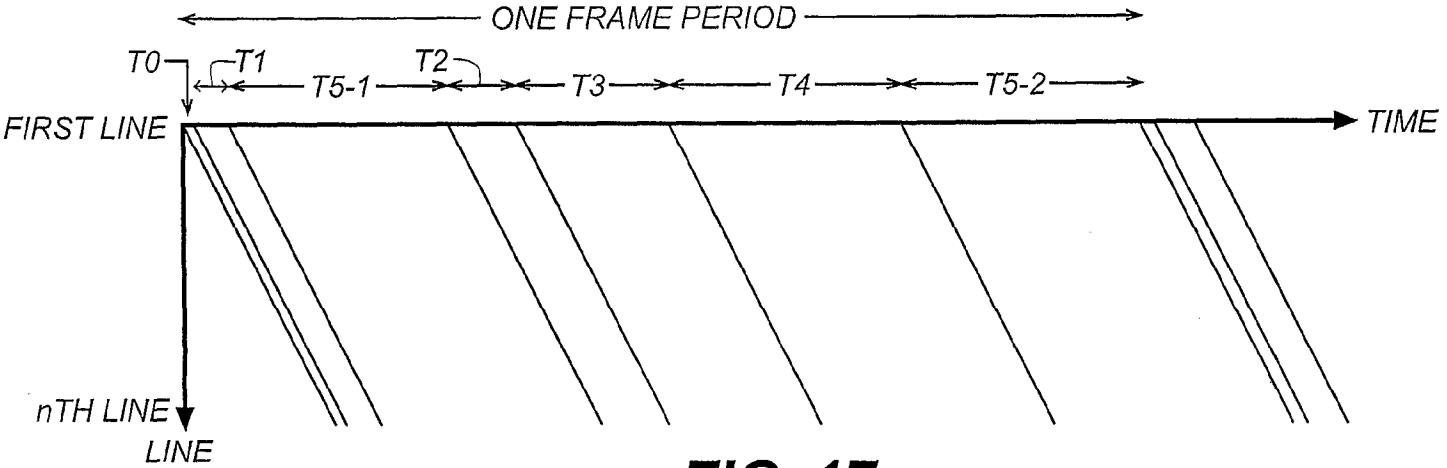
FIG. 17 is a view showing a six-bit digital drive scanning sequence of the first embodiment.
Figure 18:
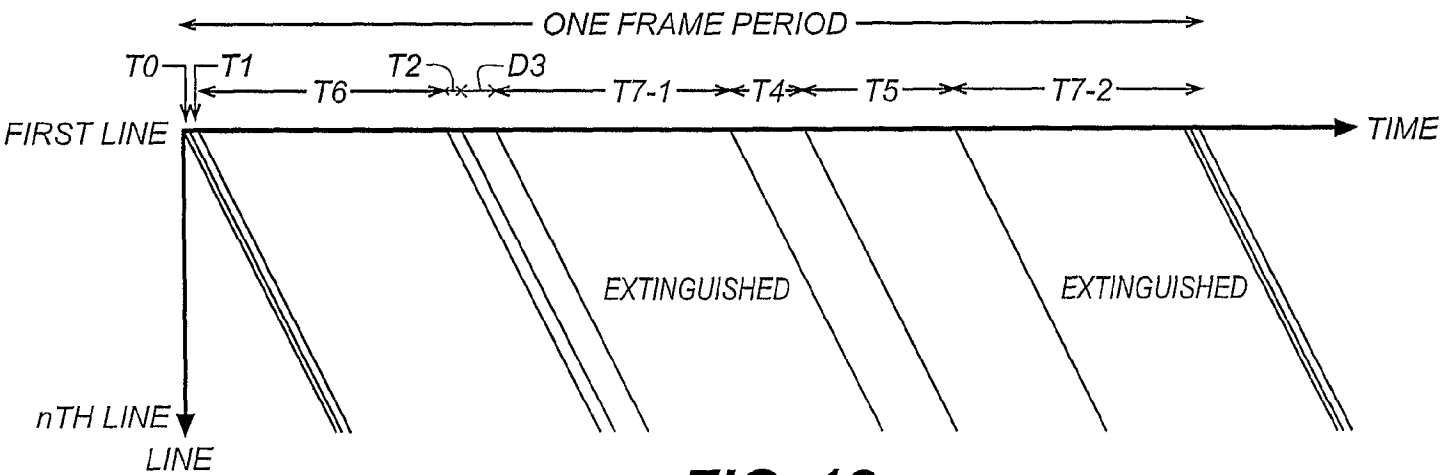
FIG. 18 is a view showing a seven-bit digital drive scanning sequence of the first embodiment.

The control method shown in FIG. 17 and FIG. 18 is also possible by adopting this method. FIG. 17 is an example of carrying out digital driving based on the present invention where subframe 5 is divided into two during six-bit, 64 gradation displaying. It is possible to reduce the number of scanning times compared with the case of 8 bits shown in FIG. 17, which is useful in low power consumption applications.

Further, FIG. 18 shows a drive example where the data for bit 7 at the time of eight-bit driving is always taken to be "0", so that the organic EL element is extinguished at the subframe period. This enables light-emitting characteristics of a cathode ray tube to be obtained so that visibility of moving images is improved. In this event, the brightness of generated light is reduced in order to reduce the illumination period but the drive voltage of the organic EL element is increased. It is therefore possible to increase the intensity of generated light to compensate for the fall in brightness. This driving is extremely useful in moving image applications such as television.

SECOND EMBODIMENT

Figure 19:
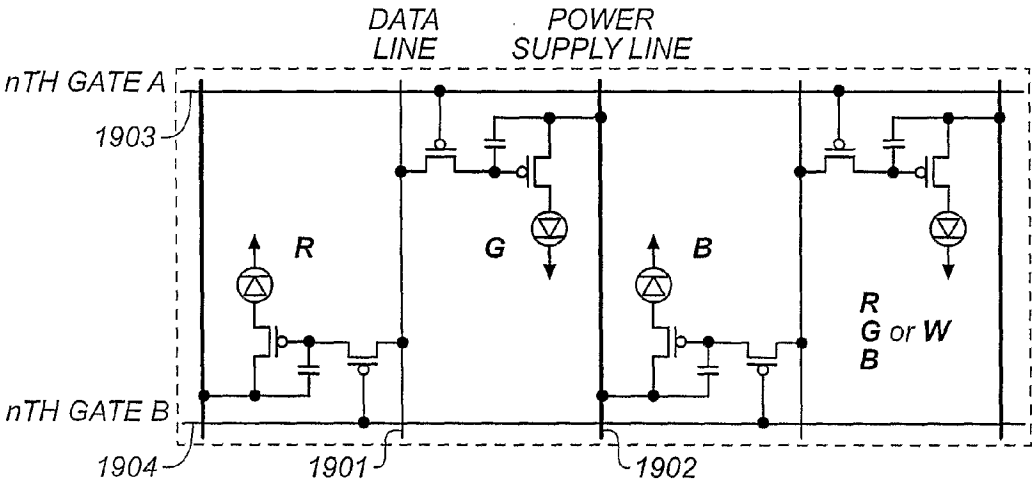
FIG. 19 is a view showing a polysilicon TFT pixel circuit 1 of the second embodiment.
Figure 20:
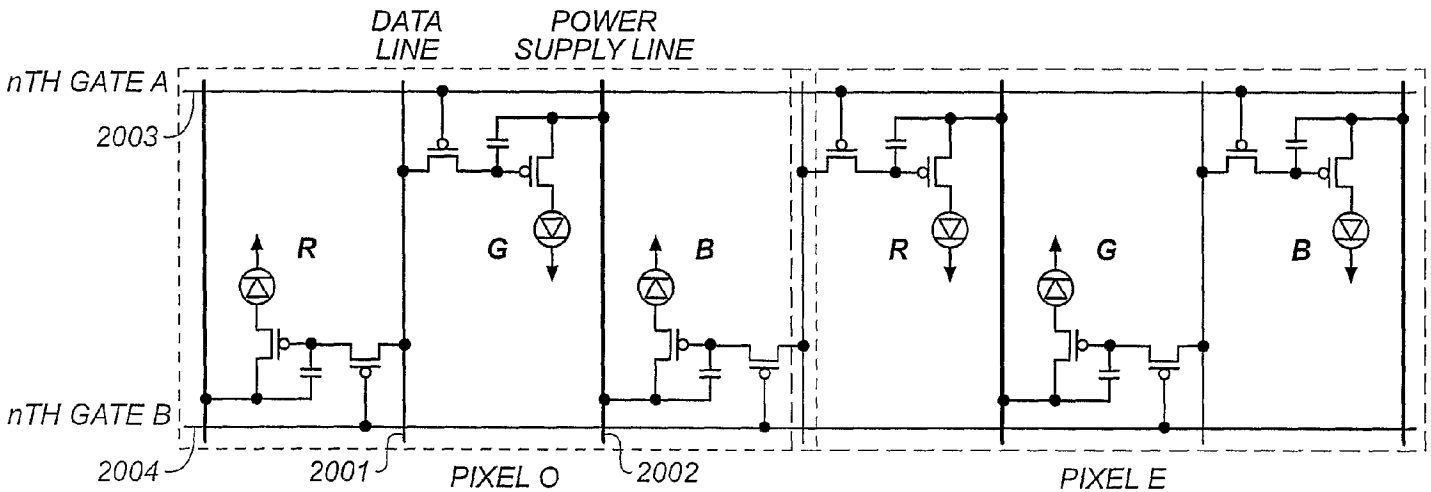
FIG. 20 is a view showing a polysilicon TFT pixel circuit 2 of the second embodiment.

FIG. 19 and FIG. 20 are examples of pixel circuits employed in a second embodiment. Numeral 1901 and 2001 are data lines, and numeral 1902 and 2002 are power supply lines. The TFT circuits within the pixels function in substantially the same way as those in FIG. 2 and description thereof is omitted. The point that the data lines 1901 and 2001 and the power supply lines 1902 and 2002 are shared by neighboring pixels is however different.

FIG. 19 shows an example of a four-pixel configuration having pixels for the three primary colors of R, G and B, and a further additional pixel for colors often used by applications etc. In the event that full color is provided using a white organic EL element and a color filter, a configuration can be considered where a color filter is not added but rather the white color is taken as is as the subpixel. The white color in this case is preferably a color coordinate used in applications etc.

FIG. 20 differs from the four-pixel configuration of FIG. 19 in being a normal three-pixel configuration, but three ways of sharing the data lines, or R and G, B and R, and G and B, exist. Namely, this is an example where the pixel configuration for odd RGB and even RGB is different.

In either of the examples in FIG. 19 and FIG. 20 the data lines are shared by neighboring pixels, with two gate lines being required for one line. Numeral 1903 and numeral 1904 are gate line A and gate line B for an nth line required for the pixels of FIG. 19, and numeral 2003 and numeral 2004 are gate line A and gate line B required at the pixels of FIG. 20.

Figure 21:
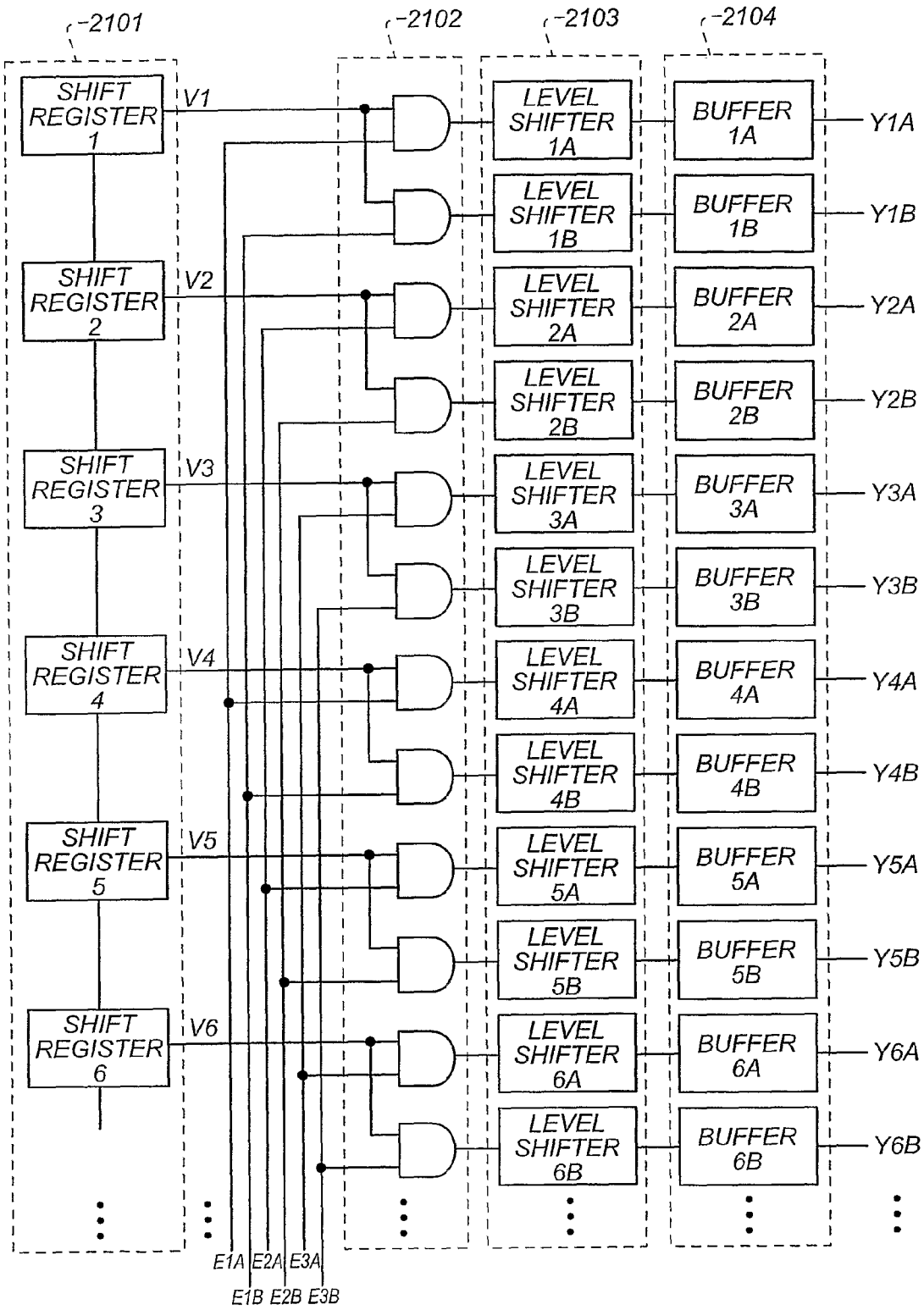
FIG. 21 is a gate driver configuration view for the second embodiment.

FIG. 21 is a view of an internal configuration for a gate driver for driving the gate lines of the pixels of FIG. 19 and FIG. 20, where numeral 2101 is a shift register, numeral 2102 is an enable circuit, numeral 2103 is a level shifter, and numeral 2104 is a buffer.

Twice the number of gate driver outputs of the case in FIG. 5 are therefore required because there are two gate lines for each one line. Twice the number of enable control lines connecting to the enable circuit 2102 are also required. As shown in FIG. 21, E1A and E1B are provided for shift register outputs V1, V4, . . . (3*i−2) (where i is a natural number), and E2A and E2B are provided for V2, V5, . . . V(3*i−1), while on the other hand, E3A and E3B are provided for V3, V6, V3*i, with the enable circuits then being controlled by these enable control lines.

Figure 22:
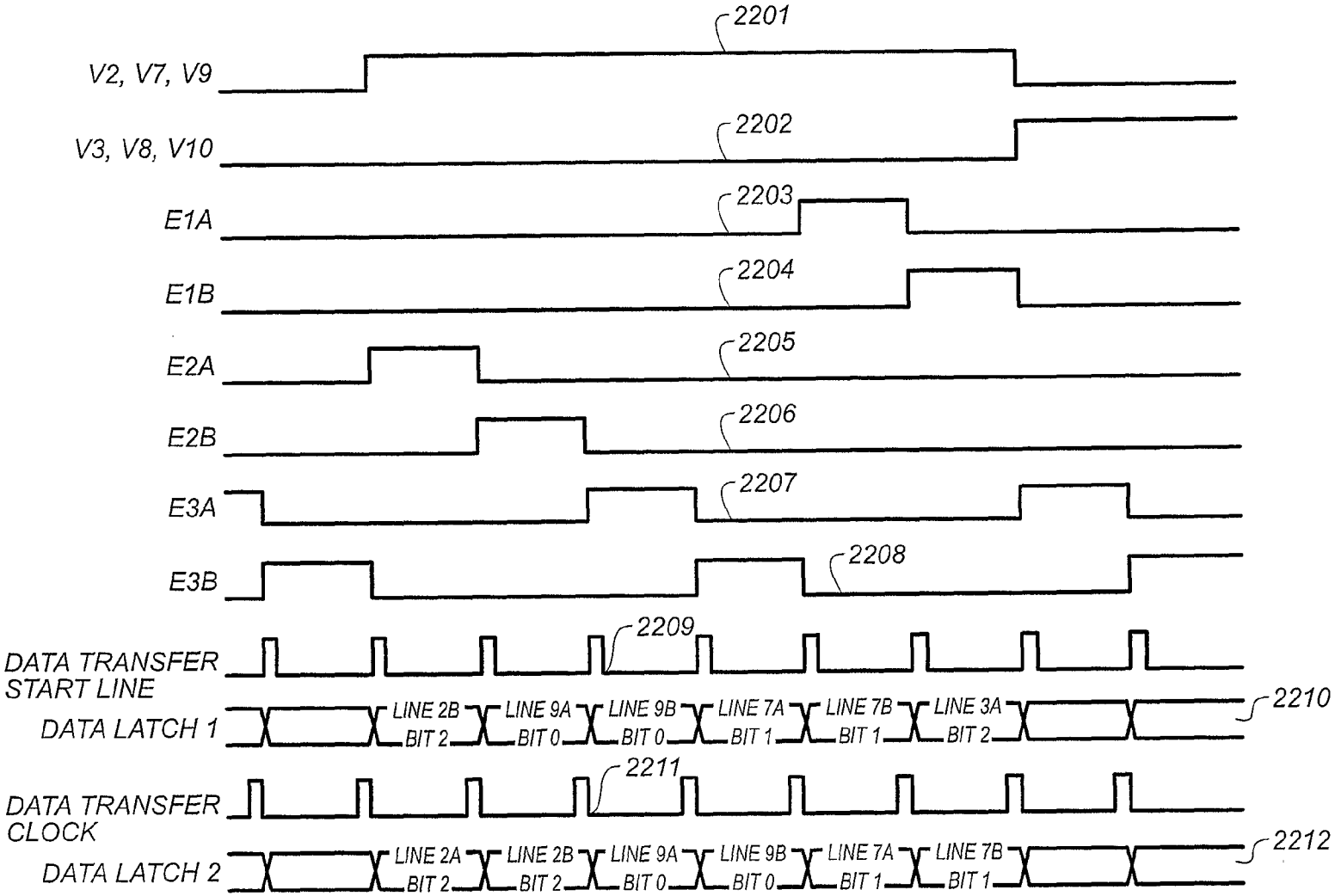
FIG. 22 is a view showing a digital drive enable timing chart of the second embodiment.

FIG. 22 shows control timing at the period XX' of FIG. 7 while using the pixels of FIG. 19 and FIG. 20 and the gate drivers of FIG. 21. Numeral 2201 is an output pulse for shift register outputs V2, V7 and V9, numeral 2202 is an output pulse for V3, V8 and V10 for one clock later, numeral 2203 and 2204 are input pulses for E1A and E1B, numeral 2205 and 2206 are input pulses for E2A and E2B, and numeral 2207 and 2208 are input pulses for E3A and E3B.

Numeral 2209 is a transfer start pulse for transferring data to the data latch 1, numeral 2210 is data for data latch 1 transferred by the pulse 2209, numeral 2211 is a clock for transferring data of the first data latch 403 to the second data latch 404, and numeral 2212 is data for a second data latch transferred by the clock 2211.

The time division sequence is substantially the same as for FIG. 8. A detailed description is omitted here but in the example in FIG. 22, the High period of the shift register V2, V7 and V9 is divided into six, and data is written.

The data for bit 2 of the second line is written in the first two periods but, first, the gate line A of the second line and then the gate line B of the second line are selected in order by first putting E2A to "High" and then putting E2B to "High". During this time, data for bit 2 written to the pixels connected to gate line A of the second line and data for bit 2 written to the pixels connected to gate line B of the second line is sequentially transferred to as to be outputted at the data lines. Data is therefore written to the pixels of gate lines A and B of the second line.

In the next two periods, writing of the ninth line is completed by putting E3A and E3B for gate lines A and B of the ninth line "High", and transferring data for bit 0 of pixels connected to the gate lines A and B of the ninth line to the second data latch. Bit 1 data for the seventh line is also written in a similar manner.

It is therefore possible to carry out digital driving of the present invention using the pixels of FIG. 19 and FIG. 20 by performing control in this manner using the gate driver of FIG. 21.

The data lines required at the panel are half that of the case where sharing does not take place in the embodiment where data lines are shared between neighboring pixels. This means that it is also possible to halve the circuitry required to drive each data line and as there may also be fewer data buses, the number of circuits for the data driver 102 can also be dramatically reduced. The power supply wiring can also be reduced by half. This means that sufficient wiring spacing can be achieved compared with the case of not sharing and the wiring short defects etc. occurring in manufacture can be suppressed. This is particularly beneficial for panels demanding a high-definition specification in the horizontal direction.

On the other hand, the number of gate driver circuits is increased by the number of data lines and power supply lines is reduced by half so that capacitance formed in crossing area of data line and power supply line is reduced. The footprint of the buffer circuit can therefore be reduced and circuit surface area can be suppressed.

THIRD EMBODIMENT

Figure 23:
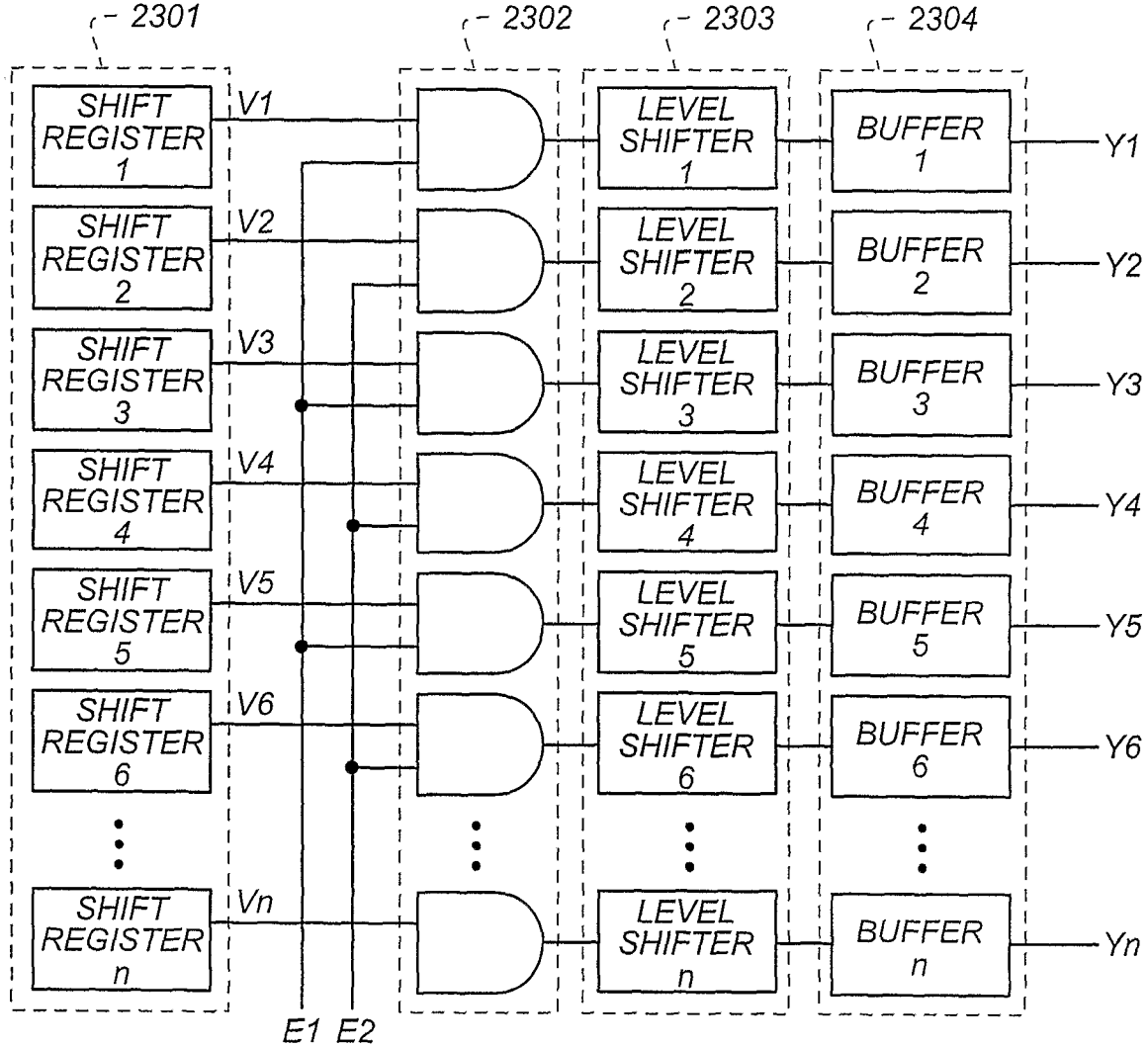
FIG. 23 is a gate driver configuration view for a third embodiment.

FIG. 23 is an internal basic configuration of a gate driver of a third embodiment. Numeral 2301 is a shift register, numeral 2302 is an enable circuit, numeral 2303 is a level shifter, and numeral 2304 is a buffer.

The shift register 2301 shifts the input pulse according to the clock, and a shift pulse is outputted at a shift register output Vi (where i is a natural number). The enable circuit 2302 controls whether or not the shift register output Vi is inverted using enable signals E1 and E2. Enable circuits for odd-numbered lines are connected to enable signal E1, and enable circuits for even-numbered lines are connected to enable signal E2.

Figure 24:
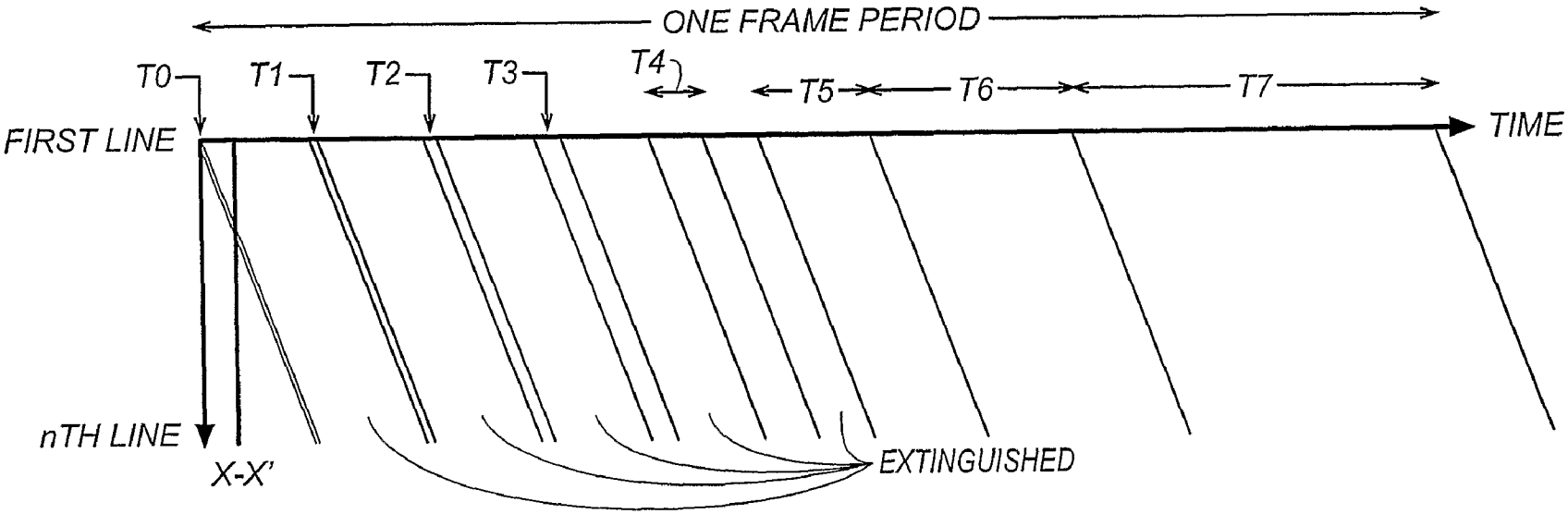
FIG. 24 is a view showing an eight-bit digital drive scanning sequence of the third embodiment.

FIG. 24 shows an eight-bit, 256 gradation display driving sequence taking the horizontal axis as time and the vertical axis as display lines. T0 to T7 are subframe periods and are controlled to that approximately T0:T1:T2:T3:T4:T5:T6:T7=1:2:4:8:16:32:64:128.

Extinguished periods are inserted at T0 to T4 because the illumination period is short and it is necessary to maintain the illumination period ratio. This is not necessary at T5 to T7 and T5 to T7 are all taken to be illumination periods. FIG. 24 only shows one example, and it is possible to further increase or reduce the subframes where extinguishing periods are inserted.

Figure 25:
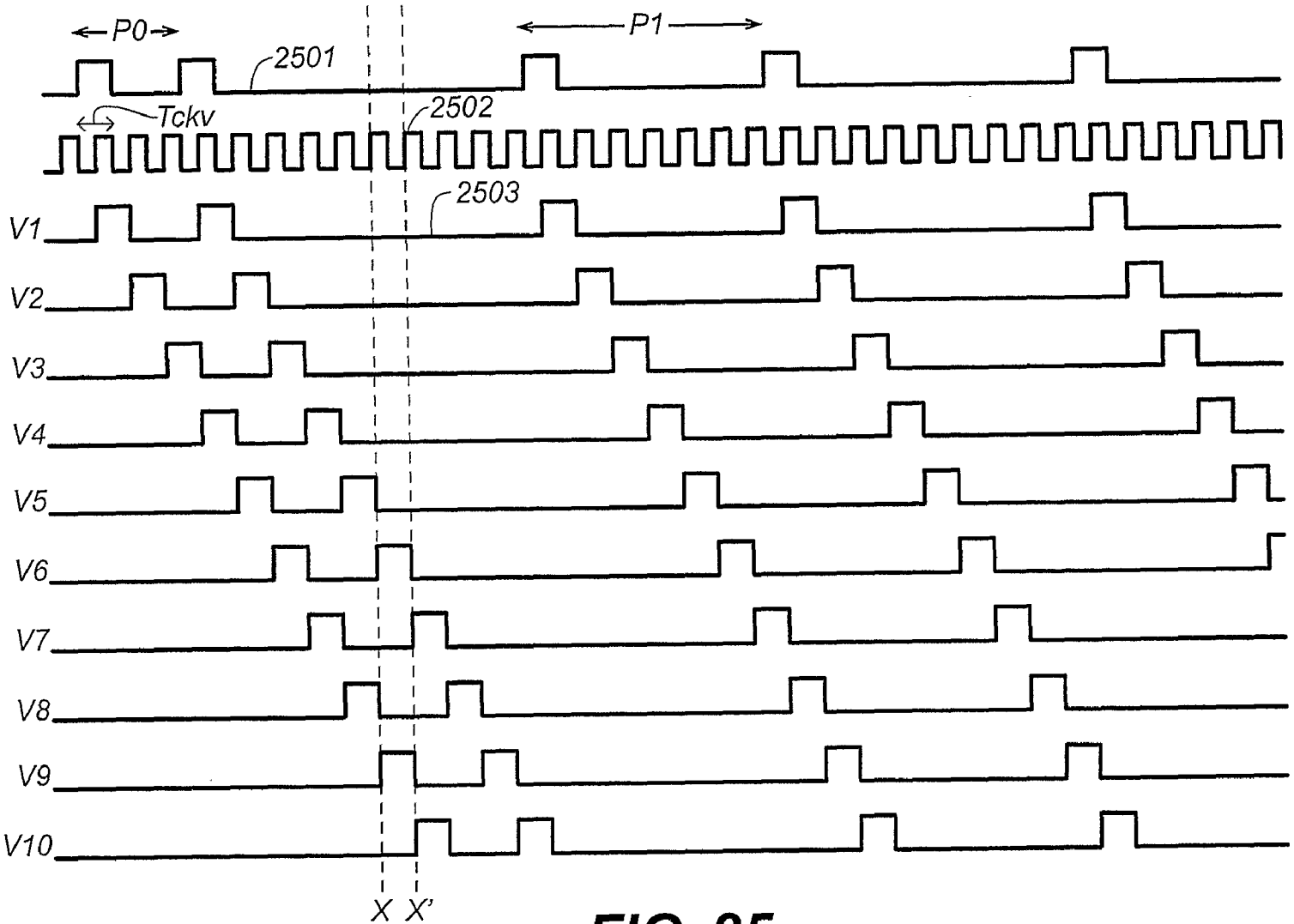
FIG. 25 is a view showing a digital drive timing chart of the third embodiment.

FIG. 25 is a partial enlarged view of section XX' of FIG. 24. FIG. 25 gives an example of a ten-line display for ease of description. Numeral 2501 and numeral 2502 are an input pulse and a shift clock inputted to the shift register 2301, respectively. Numeral 2503 is an output pulse for shift register output V1, and this pulse is sequentially shifted by a time Tckv by the clock 2502 to output each Vi.

The input pulse 2501 inputs pulses at pulse intervals P0 to P7. The subframe intervals T0 to T7 are controlled to the ratio described above by setting the pulse intervals P0 to P7 in an appropriate manner.

Figure 26:
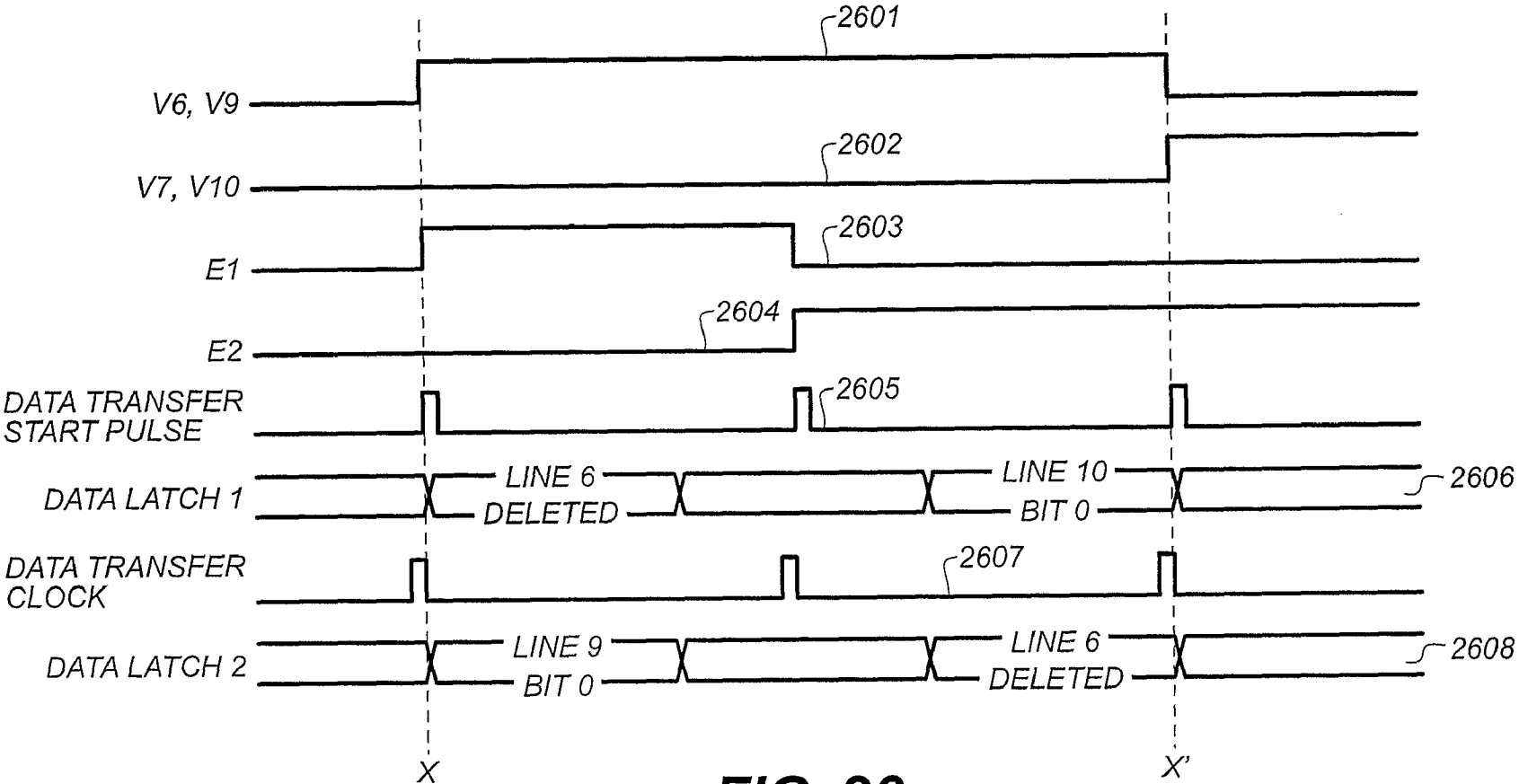
FIG. 26 is a view showing a digital drive enable timing chart of the third embodiment.
Figure 28:
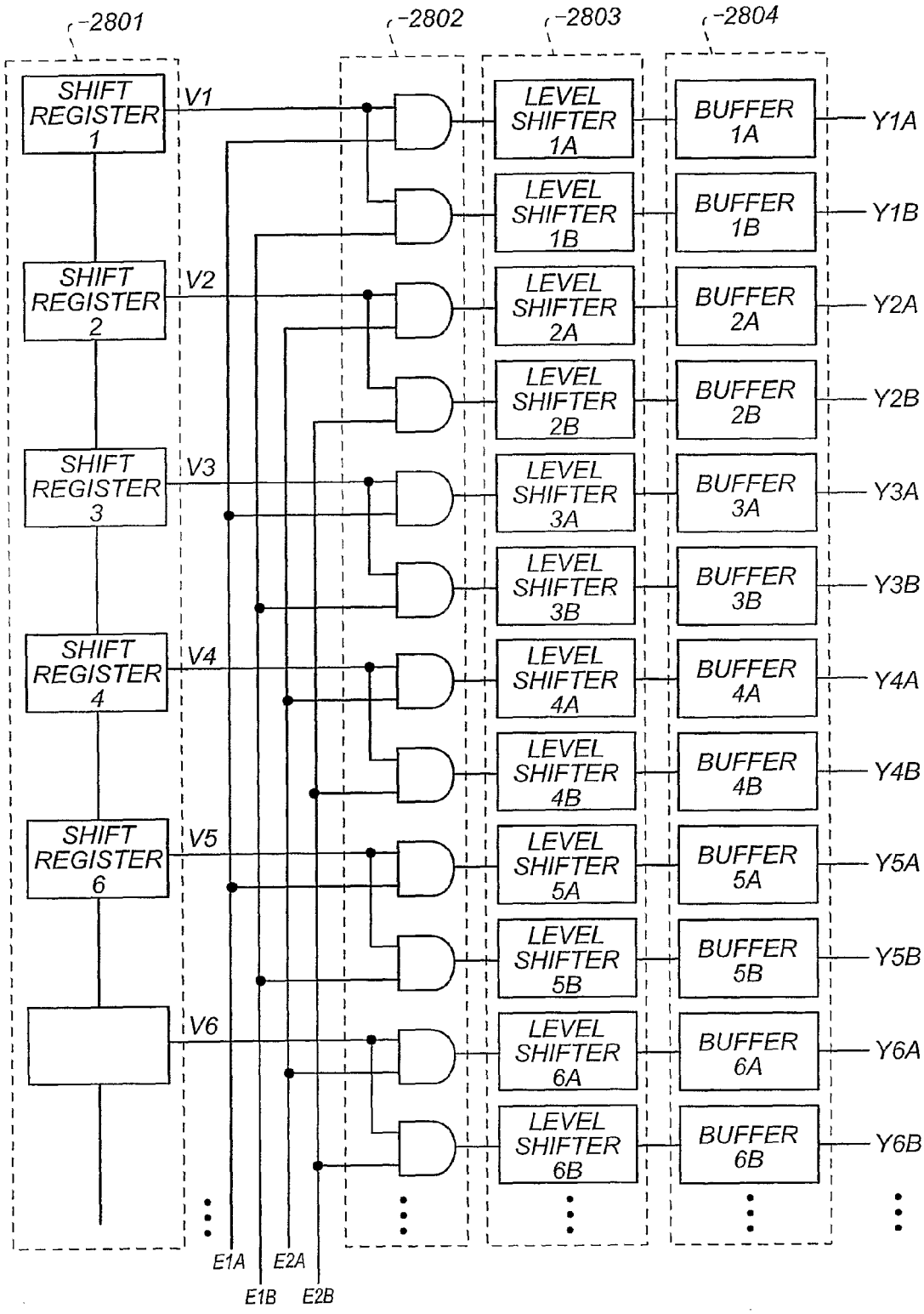
FIG. 28 is a gate driver configuration view for a fourth embodiment.

FIG. 26 is a partial enlarged view of section XX'. Numeral 2601 is an output pulse for shift register outputs V6 and V9, numeral 2602 is an output pulse for shift register outputs V7 and V10, numeral 2603 and 2604 are pulses for enable signals E1 and E2, numeral 2605 is a pulse for starting transmission of data to the first data latch 403, numeral 2606 is hold data for the first data latch 403, numeral 2607 is a transfer clock for transferring hold data 2606 of the first data latch to the second data latch 404, and numeral 2608 is hold data for the second data latch 404.

At the front half of section XX', the output pulse 2601 of V6 and V9 is "High", enable pulse 2603 for E1 is "High", and enable pulse 2604 of E2 is "Low". The gate line for V9 that is an odd-numbered line therefore becomes active, and data for bit 0 of the ninth line held at the second data latch is written to the pixels.

At the rear half, the output pulse 2601 of V6 and V9 is "High", enable pulse 2603 for E1 is "Low", and enable pulse 2604 of E2 is "High". The gate line for V6 that is an even-numbered line therefore becomes active, and erase data for the sixth line held at the second data latch is written to the pixels.

The sixth line is already written with data for bit 0. The subframe period T0 is therefore P0+0.5*Tckv. Here, it is necessary for P0=(2*k0−1)*Tckv (k0 is a natural number).

As shown in the drive sequence of FIG. 24, the remaining T1 to T4 are also similarly calculated from pulse intervals P1 to P4. From T5 onwards, the subframe periods are long at more than the time for scanning all lines from the first line, and it is therefore no longer necessary to carry out the scanning for extinguishing carried out for T0 to T4. The subframe periods T5 to T7 therefore coincide with P5 to P7.

Pulse intervals P0 to P7 for each subframe SF0 to SF7, subframe periods T0 to T7, and their ratios are shown for an example of driving for an embodiment in FIG. 27.

According to the method of this embodiment, as can be understood from FIG. 27, it is possible to set the subframe ratios with comparatively good precision. The continuity of the input gradation and the output gradation is therefore good, and a smooth image can be obtained.

FOURTH EMBODIMENT

In a fourth embodiment, a description is given of a method for driving employing the drive method of the third embodiment and employing the pixels shown in FIG. 19 and FIG. 20.

FIG. 23 is an basic configuration of a gate driver of this embodiment. Numeral 2801 is a shift register, numeral 2802 is an enable circuit, numeral 2803 is a level shifter, and numeral 2804 is a buffer.

Two enable circuits 2802 are prepared for each one line, with one being used to control a gate line A, and the other being used to control a gate line B.

E1A, E1B, E2A and E2B are enable control lines, with E1A and E1B being connected to enable circuits of odd lines, and E2A and E2B being connected to enable circuits of even lines.

Figure 29A:
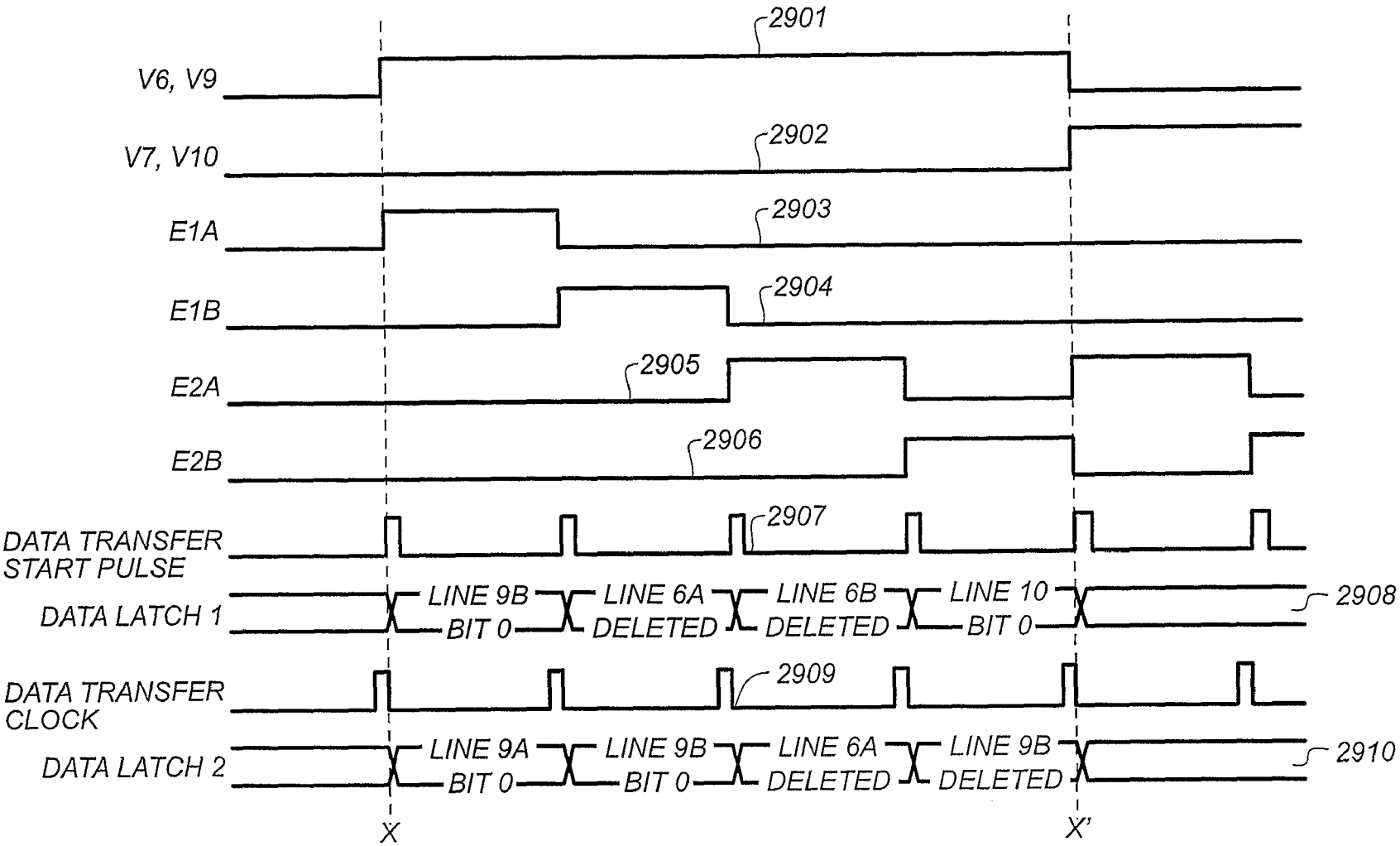
FIG. 29 is a view showing a digital drive enable timing chart of the fourth embodiment.
Figure 29B:
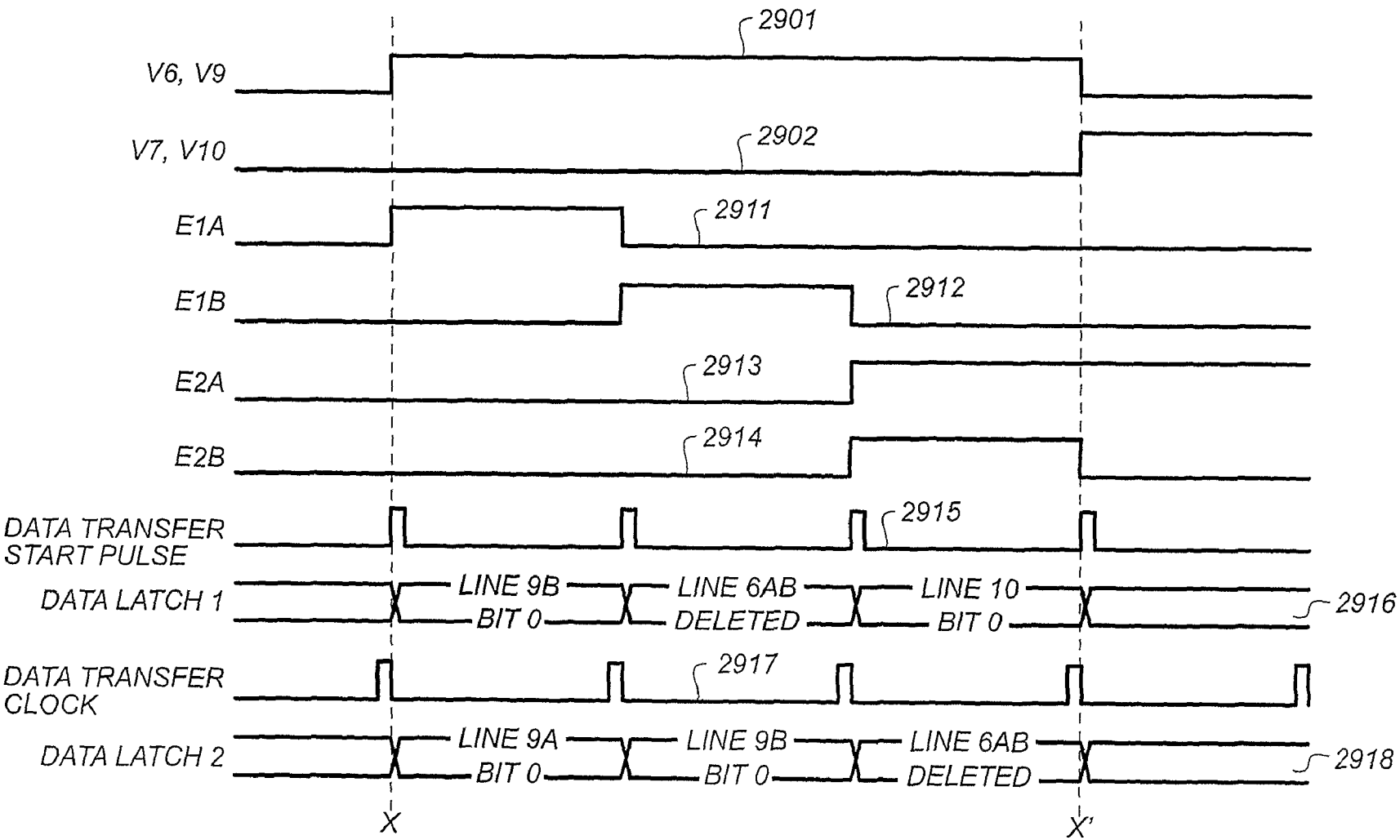

FIG. 29 is a partial enlarged view of section XX' of FIG. 25, with FIG. 29(1) showing an example of a four-division type, and FIG. 29(2) showing an example of a three division type. Numeral 2901 is an output pulse for shift register outputs V6 and V9, numeral 2902 is an output pulse for V7 and V10, numeral 2903, 2904, 2905 and 2906 are enable pulses for E1A, E1B, E2A and E2B respectively, numeral 2907 is a four-division type data transfer start pulse for sequentially transferring data on the data bus to the first data latch 403, numeral 2908 is data for the four division-type first data latch 403, 2909 is a four-division type transfer clock for transferring data of the first data latch 403 to the second data latch 404, and 2910 is data for the four-division type second data latch 404.

Numeral 2911, 2912, 2913 and 2914 are enable pulses for the three-division type enable pulses E1A, E1B, E2A and E2B, numeral 2915 is a three-division type data transfer start pulse, numeral 2916 is data for the three-division type first data latch 403, 2917 is a three-division type data transfer clock, and numeral 2918 is data for a three-division type second data latch 404.

At the four-division type of FIG. 29(1), the gate line A and gate line B of the ninth line are put to active in the order E1A and E1B in the second period of the first half, and data for bit 0 of line 9A and line 9B is written. In the second period of the latter half, the gate line A and gate line B of the sixth line are put active in the order of E1A and E1B, and the data for line 6A and line 6B is erased.

At the three-division type of FIG. 29(2), the gate line A and gate line B of the ninth line are put to active in the order E1A and E1B in the first and second periods, and data for bit 0 of line 9A and line 9B is written. In the final period, the gate lines A and B of the sixth line are put to active by controlling E1A and E1B at the same time, and the data for line 6 is deleted at the same time.

It is possible to control gate lines A and B in an even manner when control in the four-division type of FIG. 29(1) becomes complex, and display quality can be maintained. On the other hand, the three-division type of FIG. 29(2) performs a deletion operation for the gate lines A and B at the same time. This has the benefit that the control period can be made short, but there is the possibility that display quality may be influenced somewhat because the control periods for the gate line A and gate line B are different.

In the method of this embodiment it is possible to reduce the number of data lines by sharing data lines between neighboring pixels. This means that it is also possible to reduce the circuit scale of the data driver by half.

FIFTH EMBODIMENT

The first to fourth embodiments show example configurations where circuits are constructed on a glass substrate using polysilicon TFTs etc, but similar driving is also possible using an amorphous silicon TFT substrate.

Figure 3:
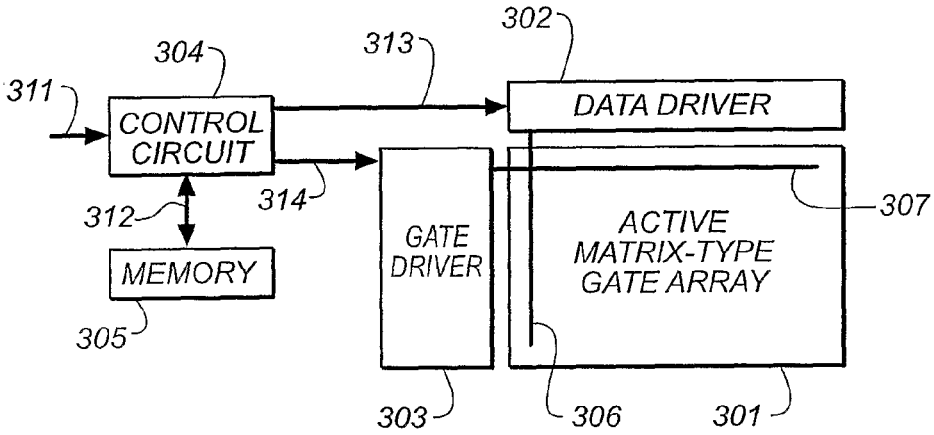
FIG. 3 is a view showing an overall configuration of a fifth embodiment.

A description is now given using FIG. 3 of an overall configuration for implementing digital driving of this embodiment using an amorphous silicon TFT substrate. Numeral 301 is an active matrix-type amorphous silicon TFT array, numeral 302 is a data driver, numeral 303 is a gate driver, numeral 304 is a control circuit, and numeral 305 is a frame memory.

The data driver 302 and gate driver 303 are comprised of a plurality of driver IC such as those used in LCDs etc., and are connected to a glass substrate of the amorphous silicon TFT array 301 using a TCP (Tape Carrier Package) or are directly mounted on the glass substrate using COG (Chip On Glass).

In the event that, for example, the number of pixels of that of an XGA (RGB 1024×768) amorphous silicon TFT array, eight data driver ICs for output 384 and three gate driver ICs for output 256 are mounted at the data driver 302.

Numeral 306 is a data line, numeral 307 is a gate line, data line 306 is connected to an output of data driver 302, and gate line 307 is connected to an output of gate driver 303.

Numeral 313 is a signal bus for transferring a signal provided to the data driver 302 from the control circuit 304, numeral 314 is a signal bus for transferring a signal provided to the gate driver 303, numeral 312 is a signal bus for a frame memory, and numeral 311 is an input signal bus.

The format of the data written to the frame memory by the control circuit 304 is the same as for the first embodiment, and description thereof will therefore be omitted.

Figure 30:
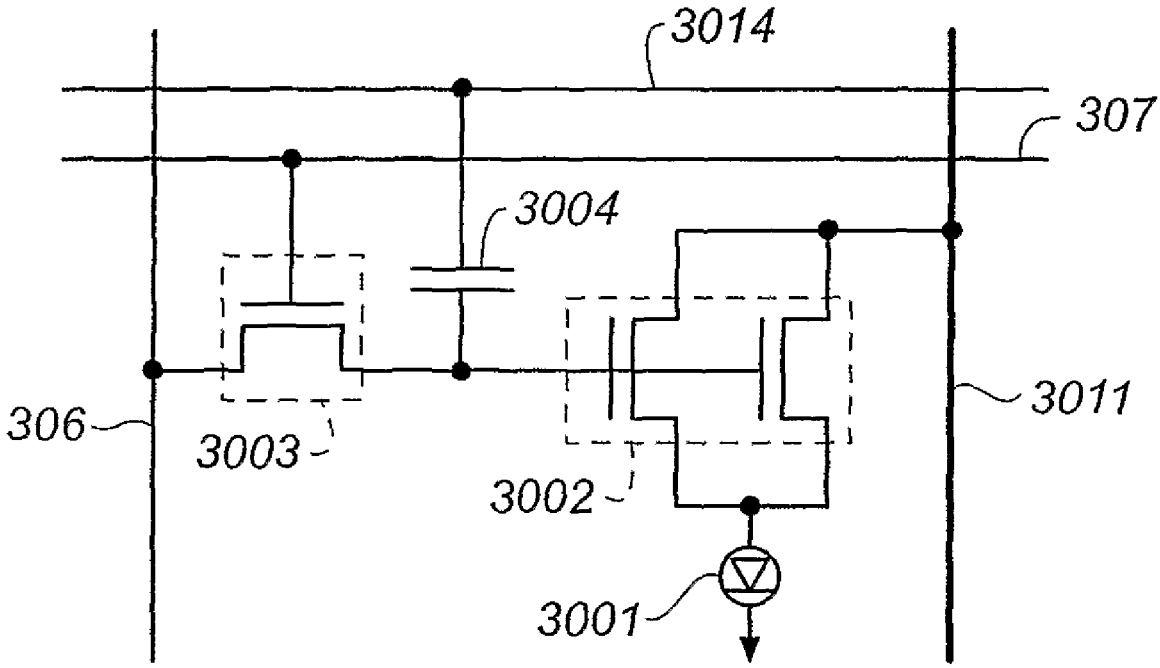
FIG. 30 is a view showing an amorphous silicon TFT pixel circuit of a fifth embodiment.

FIG. 30 shows pixel circuits on the amorphous silicon TFT array 301. N-type is usually used in the case of forming TFTs with amorphous silicon. The pixel circuits of FIG. 30 are therefore all N-type.

Numeral 3001 is an organic EL element, numeral 3002 is an drive TFT controlling whether or not current flows in the organic EL element 30001, numeral 3003 is a gate TFT for controlling writing of on/off voltages of the TFT 3002, and numeral 3004 is a hold capacitor for holding on/off voltages written by the gate TFT 3003.

Numeral 3011 is a power supply line for supplying current to the organic EL element 3001, and numeral 3014 is a reference voltage line.

The drain terminal of the drive TFT 3002 is connected to the power supply line 3011, and the source terminal is connected to the anode terminal of the organic EL element 3001. The gate terminal of the drive TFT 3002 is connected to the hold capacitor 3004 and the source terminal of the gate TFT 3003. The gate terminal of the gate TFT 3003 is connected to the gate line 307, and the drain terminal is connected to the data line 306.

The drive TFT 3002 adopts a redundant structure of two TFTs in parallel for the same reasons as give above for the first embodiment.

The configuration of the data driver 302 and the gate driver 303 provided as a drive circuit is as disclosed in, for example, P139 of the February 2004 edition of "Transistor Technology" published by CQ, and description is therefore omitted here, but this configuration is similar to the configuration of FIG. 4 and FIG. 5.

Regarding the data driver 302, a DA converter for converting six-bit or eight-bit digital input gradation data to an analog gradation voltage is built-in, with a converted analog gradation voltage being outputted at the data line 306. The digital driving may be a two-value voltage level. It is therefore beneficial from a cost point of view for the data driver IC to adopt the configuration shown in FIG. 4.

The configuration of the gate driver 303 is extremely similar to the configuration of FIG. 5, with most gate driver ICs having three enable control lines.

If a data driver IC and gate driver IC is employed, or if an IC having a function described up to this point is employed, it is possible to carry out digital driving that is capable of high display uniformity using a large screen using amorphous silicon that enables large-type TFT arrays to be made at low cost. This makes it possible to implement large type TVs and large type monitors using organic EL elements at a comparatively low cost.

PARTS LIST

101 active matrix display array
102 data driver
103 select driver
104 display device
105 control circuit
106 frame memory
107 driving data lines
108 driving select lines
109 level shifter
111 input signal bus
112 memory bus
113 signal bus
114 gate signal bus
201 organic EL element
202 drive TFT
203 gate TFT
204 hold capacitor
211 supply line
212 reference potential line
256 output
301 active matrix-type amorphous silicon TFT array
302 data driver
303 gate driver
304 control circuit
305 frame memory
306 data line
307 gate line
311 input signal bus
312 signal bus
313 signal bus
314 signal bus
384 output
401 data bus
402 shift register
403 first data latch
404 second data latch
405 buffer
406 control signal line
501 shift register
502 enable circuit
503 level shifter
504 buffer
701 input pulse
702 clock
703 output V1
801 shift register output
802 output pulse
803 pulse
804 pulse
805 pulse
806 data transfer
807 data
808 clock
809 data
901 output pulse
902 output pulse
903 enable signal
904 enable signal
905 enable signal
907 first data latch
909 data for the second data latch
1201 four-bit input graduation data
1202 digital drive format data
1203 digital drive format data
1501 output pulse
1502 output pulse
1503 enable pulse
1504 enable pulse
1505 enable pulse
1506 pulse
1508 clock
1509 data
1901 data line
1902 power supply line
1903 gate line
1904 gate line
2001 data line
2002 power supply line
2003 gate line
2004 gate line
2101 shift register
2102 enable circuit
2103 level shifter
2104 buffer
2201 output pulse
2202 output pulse
2203 input pulse
2204 input pulse
2205 input pulse
2206 input pulse
2207 input pulse
2208 input pulse
2209 transfer start pulse
2210 data
2211 clock
2212 data
2301 shift register
2302 enable circuit
2303 level shift
2304 buffer
2501 input pulse
2502 input pulse
2503 output pulse
2601 output pulse
2602 output pulse
2603 pulses
2604 pulses
2605 pulse
2606 hold data
2607 transfer clock
2608 hold data
2801 shift register
2802 enable circuit
2803 level shifter
2804 buffer
2901 output pulse
2902 output pulse
2903 enable pulse
2904 enable pulse
2905 enable pulse
2906 enable pulse
2907 four division type data transfer start pulse
2908 data
2909 four-division type transfer clock
2910 data
2911 enable pulse
2912 enable pulse
2913 enable pulse

2914 enable pulse
2915 three division type data transfer start pulse
2916 data
2917 three-division type data transfer cock
2918 data
3001 organic EL element
3002 drive TFT controlling
3003 gate TFT
3004 hold capacitor
3011 power supply line
3014 reference voltage line

The invention claimed is:

1. A display device comprising:

a display array having a plurality of pixel circuits being arranged in a matrix, wherein each pixel circuit includes a optoelectronic element and a plurality of thin-film transistors for controlling the optoelectronic element;

data lines arranged to correspond to columns of pixel circuits of the display array for providing data signals to the pixel circuits;

a data driver for driving the data lines;

select lines for providing select signals for controlling the capture of data signals from the data lines to pixel circuits; and a select driver for driving the select lines including a shift register for sequentially shifting a line select signal, enable circuits for enabling outputs of the shift register, and n (where n is an integer of two or more) enable control lines for controlling the enable circuits, and the enable circuits are connected to the same one of the enable control lines every n lines.

2. The display device as disclosed in claim 1, wherein the display array, the data driver, and the select driver are formed on a single glass substrate.

3. The display device as disclosed in claim 1, wherein a period that the line select signal of the shift register is held in an address is divided by n, and over n respective divided periods, one of the n enable control lines that is not-yet enabled is selected and a corresponding select line is made active.

4. The display device as disclosed in claim 1, wherein the line select signal making the n or less select lines active is inputted to the shift register in such a manner that the address of the shift register where the line select signal exists is divided by n, with the remainders all being different.

5. The display device as disclosed in claim 1, the data drivers comprising:

a data bus for sending data for each pixel as digital data;

a shift register for sequentially transferring a pulse controlling data transfer on the data bus;

a first latch for taking for one line on the data bus in accordance with the pulse of the shift register and having a capacity capable of storing one bit data for one line; and a second latch for storing data for one line taken in at the first latch, and having a capacity capable of storing one bit data for one line, wherein nth data on the select line selected at the nth period is outputted at the nth period of the n periods that are the period divided by n.

6. The display device as disclosed in claim 1, wherein the thin-film transistors controlling the optoelectronic element are accessed a plurality of times in one frame period by the select driver and the data driver, and ratios of the accessed periods from one access to re-accessing becomes $1:2:2^2:2^3:\ldots:2^n$.

7. The display device as disclosed in claim 1:

wherein the pixel circuits are such that a pair of pixel circuits neighboring each other in the horizontal scanning direction are connected to the same data line, with neighboring pixel circuits connected to the same data line being connected to different select lines, and the enable circuits of the select driver have sets of two pair enable control lines per one horizontal line for enabling outputs of the shift registers, with neighboring pixel circuits connected to the same data line being enabled separately.

8. The display device as disclosed in claim 7, wherein the pixel circuits generate four arbitrary colors of R, G, B and X, and X is one of R, G and B, or white.

9. A display device comprising:

a display array having a plurality of pixel circuits being arranged in a matrix, wherein each pixel circuit includes a optoelectronic element and a plurality of thin-film transistors for controlling the optoelectronic element;

data lines arranged to correspond to columns of the pixel circuits of the display array for providing data signals to each pixel circuit;

a data driver for driving the data lines, select lines for providing select signals for controlling the capture of data signals from the data lines at each pixel circuit; and a select driver for driving the select lines, including:

a shift register for sequentially shifting the line select signal; an enable circuit for enabling the shift register outputs; and two enable control lines for controlling the enable circuit, and the enable circuit is connected to the same one line of one of the two enable control lines separately for odd-numbered horizontal lines and even-numbered horizontal lines.

10. The display device as disclosed in claim 9, wherein the period where the line select signal of the shift register is held in same address is divided into two, and in the first period one of the two enable control lines is selected and a corresponding select line is made active, and in the second period, the remaining one is selected, and a corresponding select line is made active.

11. The display device as disclosed in claim 9, wherein the line input signal making the 2 or less select lines active is inputted to the shift register in such a manner that the address of the shift register where the line select signal exists is different for odd numbers and even numbers.

12. The display device as disclosed in claim 10, wherein the data drivers comprise:

a data bus for sending data for each pixel as digital data;

a shift register for sequentially transferring a pulse controlling data transfer on the data bus;

a first latch for taking data for one line on the data in accordance with the pulse of the shift register and having a capacity capable of storing one bit data for one line; and a second latch for storing data for one line portion taken in at the first latch, and having a capacity capable of storing one bit data for one line, and in the first period of the period divided by two, first data is outputted for select lines selected in the first period, and in the second period, extinguishing data is outputted for the select lines selected in the second period.

13. The display device as disclosed in claim 9, wherein the pixel circuits are such that a pair of pixel circuits neighboring each other in the horizontal scanning direction are connected to the same data line, with neighboring pixel circuits connected to the same data line being connected to different select lines, and the enable circuits of the select drivers have sets of two pair enable control lines per one horizontal line for enabling outputs of the shift registers, with neighboring pixel circuits connected to the same data line being enabled separately.

* * * * *